US006314059B1

(12) United States Patent
Shimizu et al.

(10) Patent No.: US 6,314,059 B1
(45) **Date of Patent: *Nov. 6, 2001**

(54) ELECTRONICALLY CONTROLLED, MECHANICAL TIMEPIECE AND CONTROL METHOD FOR THE SAME

(75) Inventors: Eisaku Shimizu, Okaya; Kunio Koike, Matsumoto; Hidenori Nakamura, Shiojiri, all of (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/163,112

(22) Filed: Sep. 29, 1998

(30) Foreign Application Priority Data

Sep. 30, 1997 (JP) ..... 9-265206
Jul. 8, 1998 (JP) ..... 10-193324
Jul. 8, 1998 (JP) ..... 10-193325

(51) Int. Cl.[7] ..... G04B 1/00; G04F 5/00
(52) U.S. Cl. ..... 368/157; 368/204
(58) Field of Search ..... 368/66, 140, 155–157, 368/203–204

(56) References Cited

U.S. PATENT DOCUMENTS 3,937,001 2/1976 Berney ..... 58/23 D
4,799,003 1/1989 Tu ..... 322/29
5,517,469 5/1996 Wiget .
5,615,178 * 3/1997 Takakura et al. ..... 368/203
5,740,131 * 4/1998 Bernasconi ..... 368/148
5,751,666 * 5/1998 Farine et al. ..... 368/140

FOREIGN PATENT DOCUMENTS 7-119812 12/1995 (JP) ..... C04C/3/14
8-50186 2/1996 (JP) ..... G04C/10/00

* cited by examiner

*Primary Examiner*—Vit Miska
(74) *Attorney, Agent, or Firm*—Stroock & Stroock & Lavan LLP

(57) ABSTRACT

A timepiece includes a mechanical energy source, a generator, and a train wheel connecting the mechanical energy source and the generator. The mechanical energy source drives the train wheel to cause the generator to rotate thereby creating electrical power. A rotation controller coupled to the generator controls the rotation of the generator, and includes a rotation detector for detecting the rotation of the generator and generating a rotation signal corresponding to the rotation and a reference signal generator for generating a reference signal based on a signal from a time reference source. The brake controller counts the reference signal and produces a first count, counts the rotation signal and produces a second count, and brakes the rotation of the generator when the first count is less than the second count.

23 Claims, 28 Drawing Sheets

ELECTRONICALLY CONTROLLED, MECHANICAL TIMEPIECE AND CONTROL METHOD FOR THE SAME

BACKGROUND OF THE INVENTION

The present invention relates to an electronically controlled, mechanical timepiece and a control method for the timepiece, in which mechanical energy in a mechanical energy source such as a mainspring is converted into electric energy by a generator, a rotation controller is driven by the electric energy to control the rotation period of the generator, and a hand attached to a train wheel is thereby accurately driven.

Japanese Examined Patent Publication No. 7-119812 and Japanese Unexamined Patent Publication No. 8-50186 disclose electronically controlled, mechanical timepieces that present accurate time by driving accurately hands attached onto train wheels. In such watches, a mainspring, when unwound, releases mechanical energy, which is converted into electrical energy by a generator. The electrical energy is then used to drive a rotation controller so that the current flowing through a coil of the generator is controlled.

The watch disclosed in Japanese Examined Patent Publication No. 7-119812 features two angular ranges: an angular range in which a brake is turned off each time a rotor makes every turn (namely, for each period of a reference signal) to heighten the rotational speed of a rotor so that the generated power is increased, and an angular range in which the rotor is turned at a low speed with the brake applied. The efficiency in power generation is increased during a high-speed rotation to compensate for a drop in power generation that takes place during the braking period.

In the watch disclosed in Japanese Unexamined Patent Publication No. 8-50186, a reference pulse and a measurement pulse detected in the course of rotation of a rotor are counted. The numbers of reference pulses and measurement pulses are compared with each other. In a first state in which the number of reference pulses is smaller than the number of measurement pulses, a controller generates a brake signal for brake control, the width of which is determined by the measurement pulse.

In either of the previously described electronically-controlled, mechanical timepieces, torque (mechanical energy) applied by a mainspring to a generator is set such that a hand is turned at a speed faster than a reference speed, and the rotational speed of the hand is adjusted by applying a brake through a rotation controller.

The watch disclosed in Japanese Examined Patent Publication No. 7-119812 performs brake-activation control and brake-deactivation control for each rotation of the rotor; namely, every reference signal. When the generator initially starts up or when the generator is largely out of control, however, the rotational control amount applied to the rotor cannot be set large enough for every reference signal to adjust the speed of the rotor in a timely fashion. Thus, a long period is required before the watch reaches its normal control state.

In the watch disclosed in Japanese Unexamined Patent Publication No. 8-50186, the pulse width of the brake signal generated for each reference signal is constant. Even with the watch largely out of control, the amount of braking for each reference signal remains constant. The watch thus needs a long period of time before reaching its normal control state.

In addition to a circuit for detecting first and second states by comparing the counts of the reference pulses and measurement pulses, a controller is required to generate a brake signal having a pulse width determined in response to the measurement pulse. Such an arrangement requires a complicated construction, which increases the cost of the watch.

In an electronically-controlled, mechanical timepiece, when the torque of the generator becomes insufficient due to the unwinding of the mainspring and the corresponding weakening of its spring force, the number of revolutions of the generator drops, thereby lowering the speed of a hand, which causes the watch to continuously lose time for a long period of time. Since the hand continuously moves even at a slow speed in this case, a user may glance at the watch and may be under the mistaken impression that the watch works correctly, even if the watch presents an incorrect time.

Accordingly, it is desirable to provide a timepiece that overcomes the drawbacks of the prior art.

SUMMARY OF THE INVENTION

Generally speaking, in accordance with the invention, an electronically-controlled, mechanical timepiece preferably includes a mechanical energy source, a generator, connected to the mechanical energy source via a train wheel and driven by the mechanical energy source, for generating induced power to feed electrical energy, a hand connected to the train wheel, a rotation controller, driven by the electrical energy, for controlling the rotation period of the generator, wherein the rotation controller includes a rotation detector for detecting the rotation period of the generator and for outputting a rotation signal corresponding to the rotation period, a reference signal generator for generating a reference signal based on a signal from a time reference source, a first counter for counting the reference signal from the reference signal generator, a second counter for counting the rotation signal from the rotation detector, and a brake controller which controls the generator so that the generator is braked when a first count provided by the first counter is smaller than a second count provided by the second counter and is not braked when the first count is equal to or greater than the second count.

The electronically-controlled, mechanical timepiece of the present invention drives the hand and the generator with a mechanical energy source, such as a mainspring, and applies a brake on the generator through the brake controller of the rotation controller, thereby governing the number of revolutions of a rotor and the hand. The first counter counts the reference signal from the reference signal generator, the second counter counts the rotation signal from the rotation detector to compare the first count and the second count, and the brake controller brakes the generator when the first count is smaller than the second count, and does not brake the generator when the first count is equal to or greater than the second count. In this way, the rotation controller of the generator governs the rotational speed of the generator.

When the first count remains smaller than the second count, namely, when the torque of the mechanical energy source, such as the mainspring, is large enough to rotate the generator, a brake is continuously applied until the difference between the two counts is eliminated. The watch thus governs the rotation of the generator, quickly allowing the generator to reach a normal rotational speed under fast response control.

Since the brake control is performed by simply comparing the two counts, a simply constructed rotation controller is provided, resulting in a cost reduction of the watch. The brake controller preferably comprises a comparator for comparing the first count with the second count. An up/down counter preferably includes a first counter, a second counter and a comparator. The use of the up/down counter permits counting while performing a comparison at the same time. With this arrangement, the construction is simplified, and the difference between counts is easily determined.

The up/down counter preferably counts at least three values. However, an up/down counter of two bits or more may be used to perform counting at multi levels and to store counts. With this arrangement, not only is a determination made of whether the second count leads or lags the first count as a reference, but also cumulative quantities of lead and lag therebetween are stored. As a result, cumulative error may be corrected.

The rotation controller, when initially supplied with electrical energy by the generator, may maintain the brake controller in an inoperative state until the number of revolutions of the generator reaches a predetermined value; for example, until the rotation signal is detected a predetermined number of times. In this way, a voltage capable of driving the rotation control means is quickly obtained, and the reliability of control is heightened.

Further, a particular threshold may be set in the up/down counter so that the braking of the generator is initiated or released when the count of the up/down counter crosses the threshold. With this arrangement, the brake control is performed by simply comparing the two counts. Such an arrangement is provided in a simple construction, resulting in a cost reduction in the manufacture of the watch.

The up/down counter is preferably set within a range of ±1 of the threshold value during the time period when the generator initially feeds electric energy to the up/down counter. With this arrangement, a small difference between a preset value of the up/down counter and the threshold permits a brake to be applied quickly after the start of the rotation control. The watch thus governs the rotation of the generator, quickly allowing the generator to reach a normal rotational speed under fast response control.

As discussed above, the up/down counter preferably counts and holds at least three values. However, the count range may extend over a plurality of counts, within which brake control is performed. Preferably, the range during which a brake is applied to the rotor is narrower than a count range wherein no brake is applied. With this arrangement, a cumulative compensation range where the rotation period of the rotor is longer than the reference period (in a state of brake release) is widened, thereby efficiently correcting a cumulative error. Specifically, when a brake is applied, the rotation period of the rotor is easily set close to the reference period, the cumulative error is small and a compensation range for the error is advantageously small. When no brake is applied, mechanical variations in the movement of the watch may increase the cumulative error. With the cumulative compensation range in the brake deactivation state set to be a relatively wide range, the cumulative error is stored and then reliably corrected.

According to a second aspect of the present invention, an electronically-controlled, mechanical timepiece includes a mechanical energy source, a train wheel driven by the mechanical energy source, a generator, driven by mechanical energy from the mechanical energy source through the train wheel, for feeding electrical energy, a hand connected to the train wheel, a rotation controller, driven by the electrical energy, for controlling the rotation period of the generator, wherein the rotation controller includes a rotation detector for detecting the rotation period of the generator and for outputting a rotation signal corresponding to the rotation period, a reference signal generator for generating a reference signal based on a signal from a time reference source, an up/down counter that receives one of the rotation signal and the reference signal as an up count input signal and the other of the rotation signal and the reference signal as a down count input signal, and a brake controller that controls the generator by applying a governing brake on the generator when the rotation period of the generator becomes shorter, causing the count of the up/down counter to reach a first set value, and by applying a hand-stopping brake on the generator when the rotation period of the generator becomes longer than a reference period with no brake applied on the generator, causing the count of the up/down counter to reach a second set value.

The timepiece of the present invention drives the hand and the generator with a mechanical energy source, such as a mainspring, and applies a brake on the generator through the brake controller of the rotation controller, thereby governing the number of revolutions of a rotor. When the up/down counter for counting the reference signal from the reference signal generator and the rotation signal from the rotation detector reaches a first set value, mechanical energy from the mechanical energy source, such as the mainspring, is large enough to rotate the generator faster than the reference signal period. During this period, the rotation controller of the generator applies a governing brake on the generator.

When mechanical energy from the mechanical energy source drops to a state in which no brake is applied to the generator (the up/down counter registers any count other than the first set value), the rotation period of the generator becomes longer than the reference period and the up/down counter reaches a second set value. The rotation controller of the generator then applies a hand stopping brake on the generator. Specifically, the hand-stopping brake control preferably applies a continuous brake on the generator to stop the hand or drive the hand at a very slow speed.

With the hand motionless or moving at a slow speed, the user recognizes the change in the hand movement when he or she looks at the hand on the watch to check the time. This arrangement helps the user avoid using the watch with no knowledge of inaccurate time keeping, and alerts the user to tighten the mainspring to restore the timepiece to the normal operating condition.

The brake controller includes a brake releasor for releasing the hand stopping brake, and the hand stopping brake, once initiated, is continuously applied until the brake is released by the brake releasor. Once the hand-stopping brake control is activated, the motionless state is reliably maintained until the normal time-keeping condition is restored, for example, by tightening the mainspring.

The brake releasor preferably releases the hand-stopping brake in response to the operation by a user of an external operational member, such as a crown or a dedicated button. The slow-turning or motionless hand of the watch reliably alerts the user to the inaccurate state of timekeeping.

The external operational member is preferably a crown. When recognizing the slow-turning or motionless hand, the user turns the crown to tighten the mainspring. If the hand-stopping brake control is designed to be released in response to the operation of the crown, the user is freed from operating a separate brake releasing operation, such as a dedicated button. The ease of operation of the watch is thus improved.

Preferably, the brake releasor includes a low-speed rotation detector for detecting the rotational speed of the generator when the rotational speed of the generator drops below a set value, and releases the hand-stopping brake when the low-speed rotation detector circuit detects a rotational speed of the generator below the set value. The hand stopping brake may be released immediately when the low-speed rotation detector detects the rotational speed of the generator below the set value, or the hand-stopping brake may be released only when the generator maintains its rotational speed lower than the set value for a predetermined duration of time.

The hand-stopping brake control is performed when energy from the mechanical energy source drops causing the generator to rotate at a lower speed. If the rotational speed of the generator drops below the predetermined set value as a result of brake control, no rise in hand-turning speed is thereafter expected even if the brake control is released. This arrangement alerts the user to an inaccurate state of timekeeping, while releasing the brake control automatically. With the brake control already released, the user adjusts the watch for the correct time smoothly when the user notices a slow-turning or motionless hand. The ease of operation is thus further promoted.

The brake releasor preferably releases the hand-stopping brake when a predetermined duration of time elapses from the moment the hand stopping brake was applied. When a brake is applied for a predetermined period (four seconds, for example) with the generator rotating at a low speed, no rise in the hand turning speed is thereafter expected in practice even if the brake is automatically released. This arrangement alerts the user to a slow-turning or motionless hand, while automatically releasing the brake control. With the brake control already released, the user can adjust the watch for the correct time smoothly upon noticing the slow-turning or motionless hand. The predetermined period for braking is determined considering the mechanical load of the watch and the torque of the mainspring, and is typically two to six seconds.

The brake controller can control the brake application such that a brake is alternately engaged for a predetermined period and released for a predetermined period during the time when the count of the up/down counter is within the second set value. In such a case, the hand-stopping brake control alternates the brake activation period and the brake deactivation period (for example, four seconds of brake on and four seconds of brake off) rather than continuously applying the brake. With this arrangement, the generator is allowed to operate when the brake is deactivated while the user turns the crown to tighten the mainspring. As a result, the rotation signal is input to the up/down counter, causing the count to change to a value other than the second set value, thereby placing the watch in the normal hand control state. This arrangement eliminates the need for a brake releasor, resulting in a cost reduction of the watch.

The second set value in such an embodiment may be equal to the first set value, and the means by which the brake controller governs the brake and the hand stopping brake may be the same. In a preferred embodiment, the up/down counter shifts to the maximum count when a down count input signal is further applied to the up/down counter when the up/down counter registers the minimum count, and shifts to the minimum count when an up count input signal is further applied to the up/down counter when the up/down counter registers the maximum count. Thus, where the first and second set values are the same and the brake controls for the governing brake and the hand stopping brake are identical, the brake control for the governing brake and the brake control for the hand stopping brake can be performed by the same construction. The watch thus features a reduced component count, a simplified construction and a reduced cost.

A method of controlling a timepiece of the present invention includes the steps of counting a reference signal based on a signal from a time reference source to determine a first count, counting a rotation signal that is output in accordance with the rotation period of the generator to determine a second count, and controlling the generator by applying a brake on the generator when the first count is smaller than the second count, and by not applying a brake on the generator when the first count is equal to or greater than the second count.

According to this control method, when the first count remains smaller than the second count, namely, when the torque of the mechanical energy source such as the mainspring is large enough to advance the generator in rotation, a brake is continuously applied until the difference between the counts is eliminated. The watch thus governs the rotation of the generator, allowing the generator to reach quickly a normal rotational speed under fast response control.

A second control method of a mechanical timepiece of the present invention includes the steps of inputting to an up/down counter a reference signal based on a signal from a time reference source and a rotation signal that is output in accordance with the rotation period of the generator, with one of the reference signal and the rotation signal used as an up count input signal and the other of the reference signal and the rotation signal used as a down count input signal, applying a brake on the generator when the up/down counter reaches a predetermined value, and not applying a brake on the generator when the up/down counter registers a value other than the predetermined value.

According to this control method, when the count of the up/down counter reaches the predetermined value, namely, when the torque of the mechanical energy source such as the mainspring is large enough to rotate the generator, a brake is continuously applied until there is no difference between the counts. The watch thus governs the rotation of the generator, allowing the generator to reach quickly a normal rotational speed under fast response control. The use of the up/down counter permits counting while performing a comparison at the same time. With this arrangement, construction is simplified, and the difference between counts is easily determined.

A third control method of a timepiece of the present invention includes the steps of inputting to an up/down counter a reference signal based on a signal from a time reference source and a rotation signal that is output in accordance with the rotation period of the generator, with one of the reference signal and the rotation signal used as an up count input signal and the other of the reference signal and the rotation signal used as a down count input signal, controlling the generator by applying a governing brake on the generator when the rotation period of the generator becomes shorter, causing the count of the up/down counter to reach a first set value, and by applying a hand stopping brake on the generator when the rotation period of the generator becomes longer than a reference period with no brake applied on the generator, causing the count of the up/down counter to reach a second set value. When mechanical energy from the mechanical energy source drops to a state in which no brake is applied to the generator (the up/down counter registers any count other than the first set value), the rotation period of the generator becomes longer than the reference period and the up/down counter reaches the second set value. The rotation controller of the generator then applies a hand stopping brake to the generator.

With the hand motionless or moving at a slow speed, the user may recognize the abnormal functioning of the watch when the user looks at the watch hand to check the time. This arrangement helps the user avoid using the watch with no knowledge of slow time, and urges the user to tighten the mainspring, permitting the user to restore the timepiece to the normal operating condition.

A first object of the present invention is to provide an electronically-controlled, mechanical timepiece that features a high response in speed control and low cost design and to provide the control method of the watch.

A second object of the present invention is to provide an electronically-controlled, mechanical timepiece that alerts the user to slow time to prevent the user from using the watch which inaccurately indicates the time.

Other objects and features of the present invention will become apparent from the following detailed description, considered in conjunction with the accompanying drawing figures. It is to be understood, however, that the drawings, which are not to scale, are designed solely for the purpose of illustration and not as a definition of the limits of the invention, for which reference should be made to the appended claims.

BRIEF DESCRIPTION OF THE DRAWINGS

In the drawing figures, which are not be scale, and which are merely illustrative, and wherein like reference numerals depict like elements throughout the several views.

DETAILED DESCRIPTION OF THE EMBODIMENTS

Figure 1:
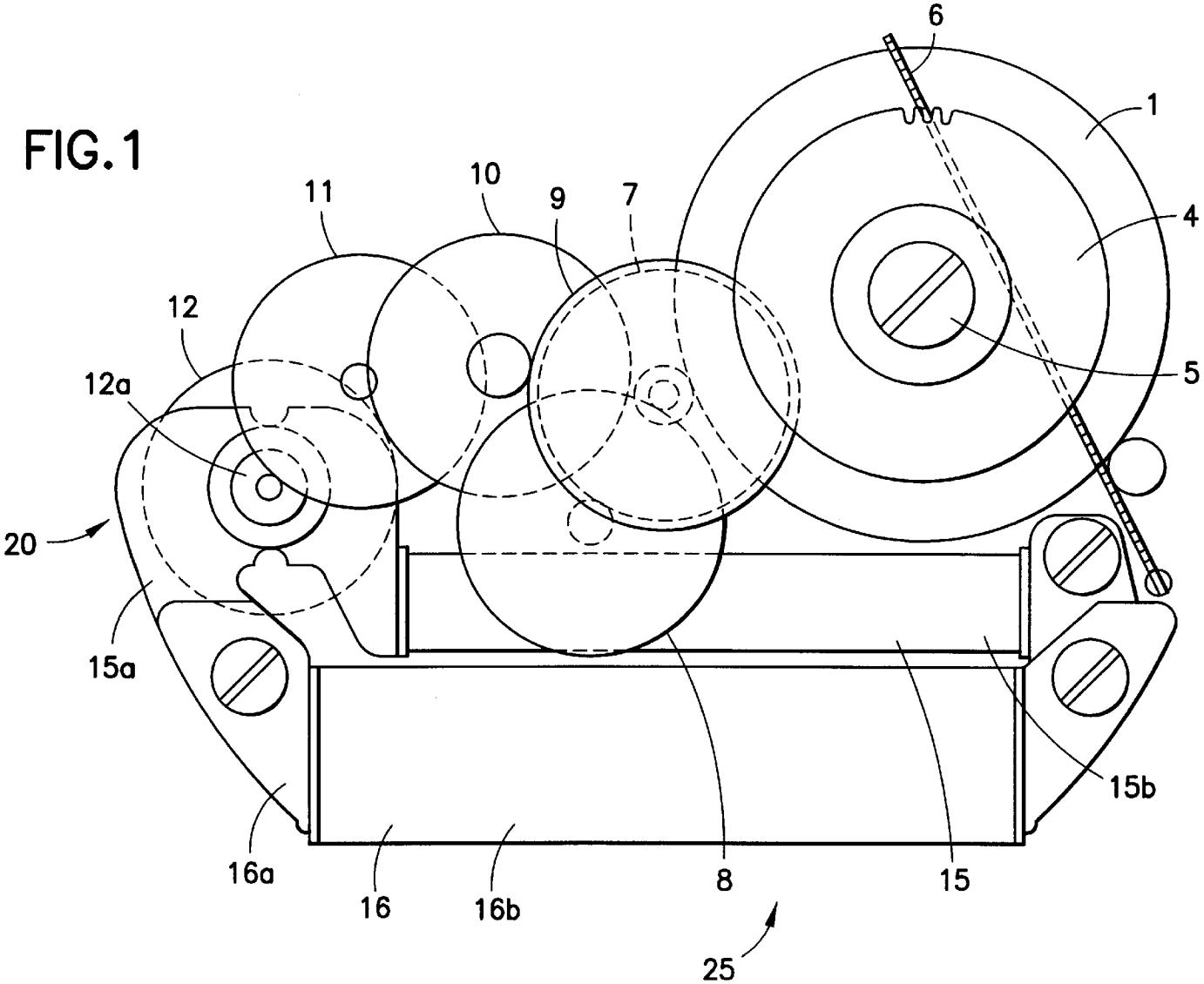
FIG. 1 is a plan view showing a timepiece constructed in accordance with the invention.
Figure 2:
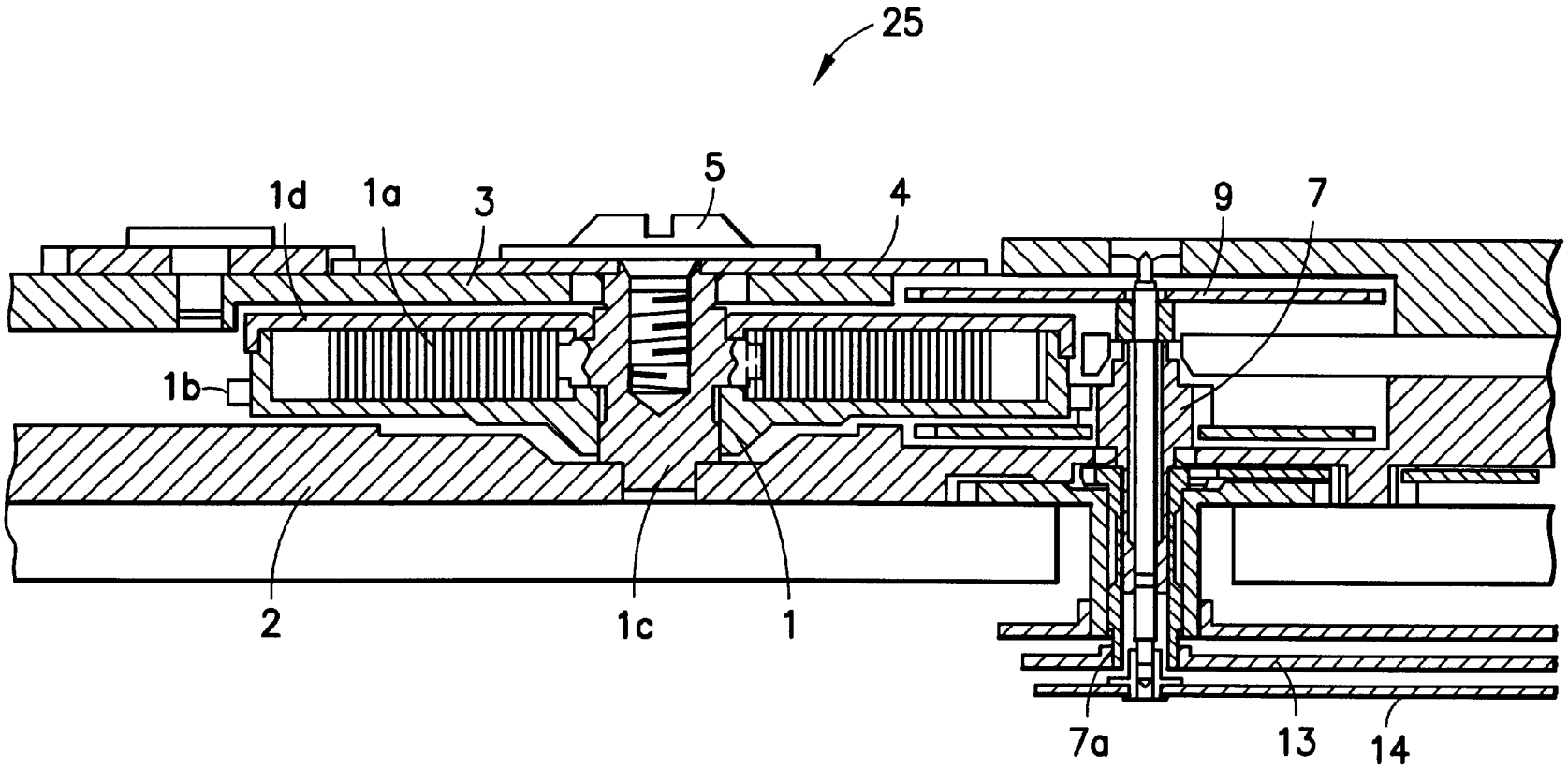
FIG. 2 is an elevational cross-sectional view of a portion of the timepiece shown in FIG. 1.

Referring to FIG. 1, a plan view showing a portion of an electronically controlled, mechanical timepiece generally depicted as reference number as 25, is constructed in accordance with of a first embodiment of the invention. Referring to FIG. 2, which depicts timepiece 25 in a front elevational cross section, timepiece 25 includes a movement barrel 1, having a mainspring 1*a*, a barrel wheel 1*b*, a barrel arbor 1*c*, and a barrel cover 1*d*. Mainspring 1*a* is supported with its outer end anchored at barrel wheel 1*b* and its inner end anchored at barrel arbor 1*c*. Barrel arbor 1*c* is supported by a main plate 2 and a train wheel support 3, and is rigidly secured to a ratchet wheel 4 by a ratchet wheel screw 5 so that both barrel arbor 1*c* and ratchet wheel 4 are integrally rotated.

Referring again to FIG. 1, ratchet wheel 4 meshes with pawl 6 that permits ratchet wheel 4 to be rotated clockwise but does not permit ratchet wheel 4 to be rotated counter-clockwise. The method of turning ratchet wheel 4 clockwise to tighten mainspring 1*a* is identical to the mechanism of self-winding or manual winding of a mechanical timepiece, which is well-known in the art and therefore is not discussed here. The rotation of barrel wheel 1*b* is stepped up in speed by a factor of seven and transmitted to a second wheel and pinion 7, and thereafter sequentially stepped up by a factor of 6.4 and transmitted to a third wheel and pinion 8, stepped up by a factor of 9.375 and transmitted to a fourth wheel and pinion 9, stepped up by a factor of three and transmitted to a fifth wheel and pinion 10, stepped up by a factor of 10 and transmitted to a sixth wheel and pinion 11, stepped up by a factor of ten and transmitted to a rotor 12. Through these step-up train wheels 7 through 11, the rotational speed is increased by a factor of 126,000.

Figure 3:
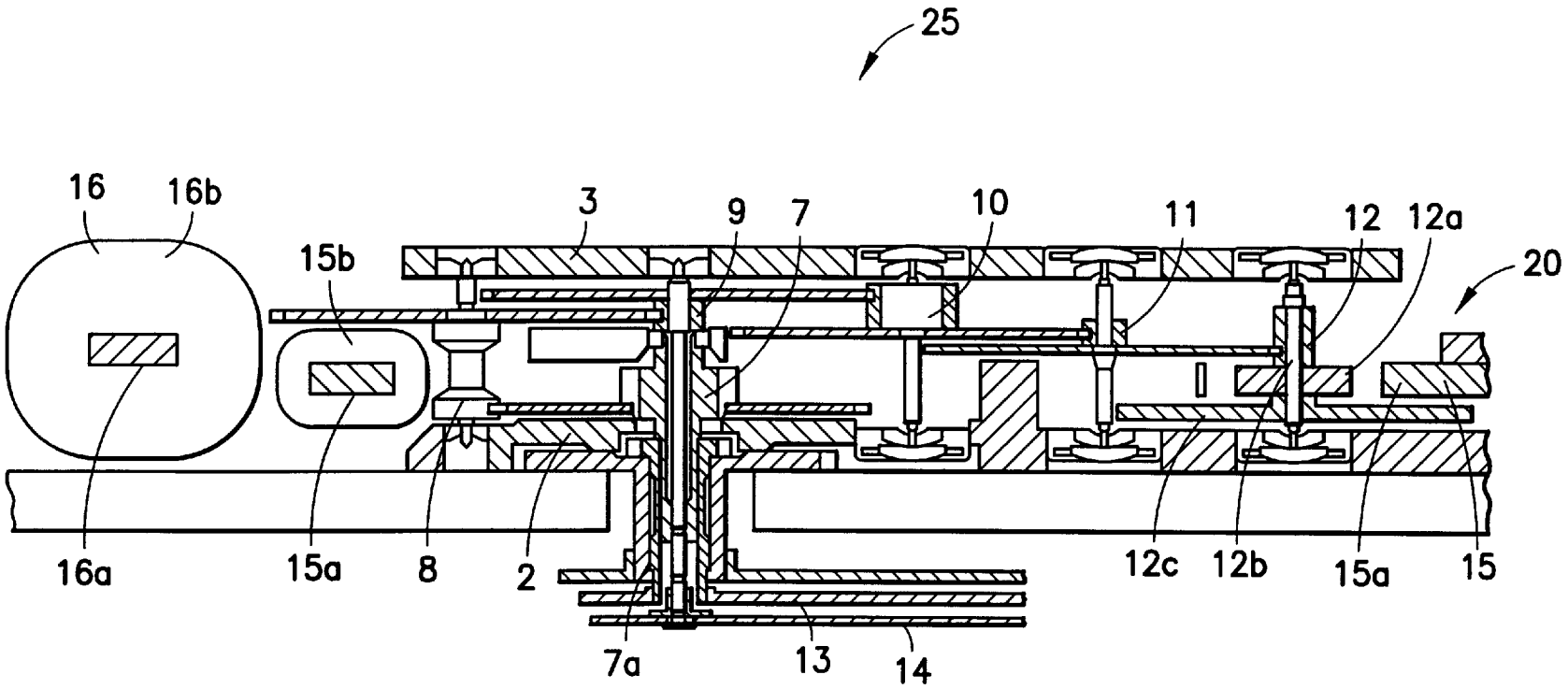
FIG. 3 is an elevational cross-sectional view of a portion of the timepiece shown in FIG. 1.

Referring to FIG. 3, second wheel and pinion 7 includes a cannon pinion 7*a* and a minute hand 13 attached to cannon pinion 7*a* for indicating time. A second hand 14 for indicating time is attached to the fourth wheel and pinion 9. To rotate second wheel and pinion 7 at 1 rph and fourth wheel and pinion 9 at 1 rpm, rotor 12 may be controlled to rotate at 5 rps. In such a case, barrel wheel 1*b* rotates at 1/7 rph.

Timepiece 25 also includes a generator 20 having rotor 12, a stator 15 and a coil block 16. Rotor 12 includes a rotor magnet 12*a*, a rotor pinion 12*b*, and a rotor flywheel 12*c*, which reduces variations in the number of revolutions of rotor 12 due to variations in driving torque of movement barrel 1. Stator 15 includes a stator body 15*a* around which a stator coil 15*b* having 40,000 turns is wound. Coil block 16 includes a coil core 16*a* around which a coil 16*b* having 110,000 turns by way of example, is wound. Stator body 15*a* and coil core 16*a* are made of PC Permalloy or of other materials known in the art. Stator coil 15*b* and coil 16*b* are connected in series so that the sum of the voltages across these coils is output.

Figure 4:
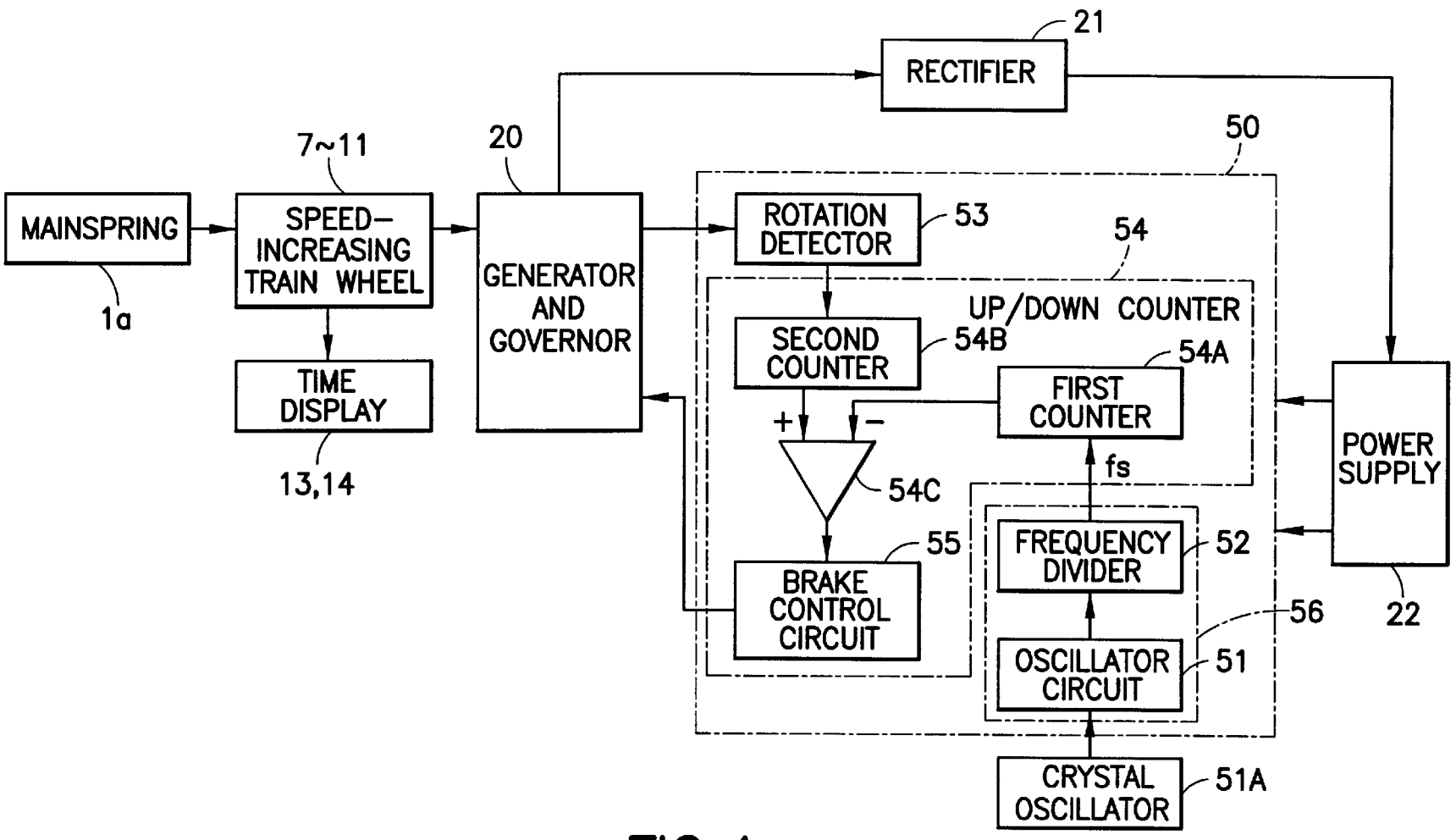
FIG. 4 is a block diagram depicting the timepiece control circuit constructed in accordance with the first embodiment of the invention.
Figure 5:
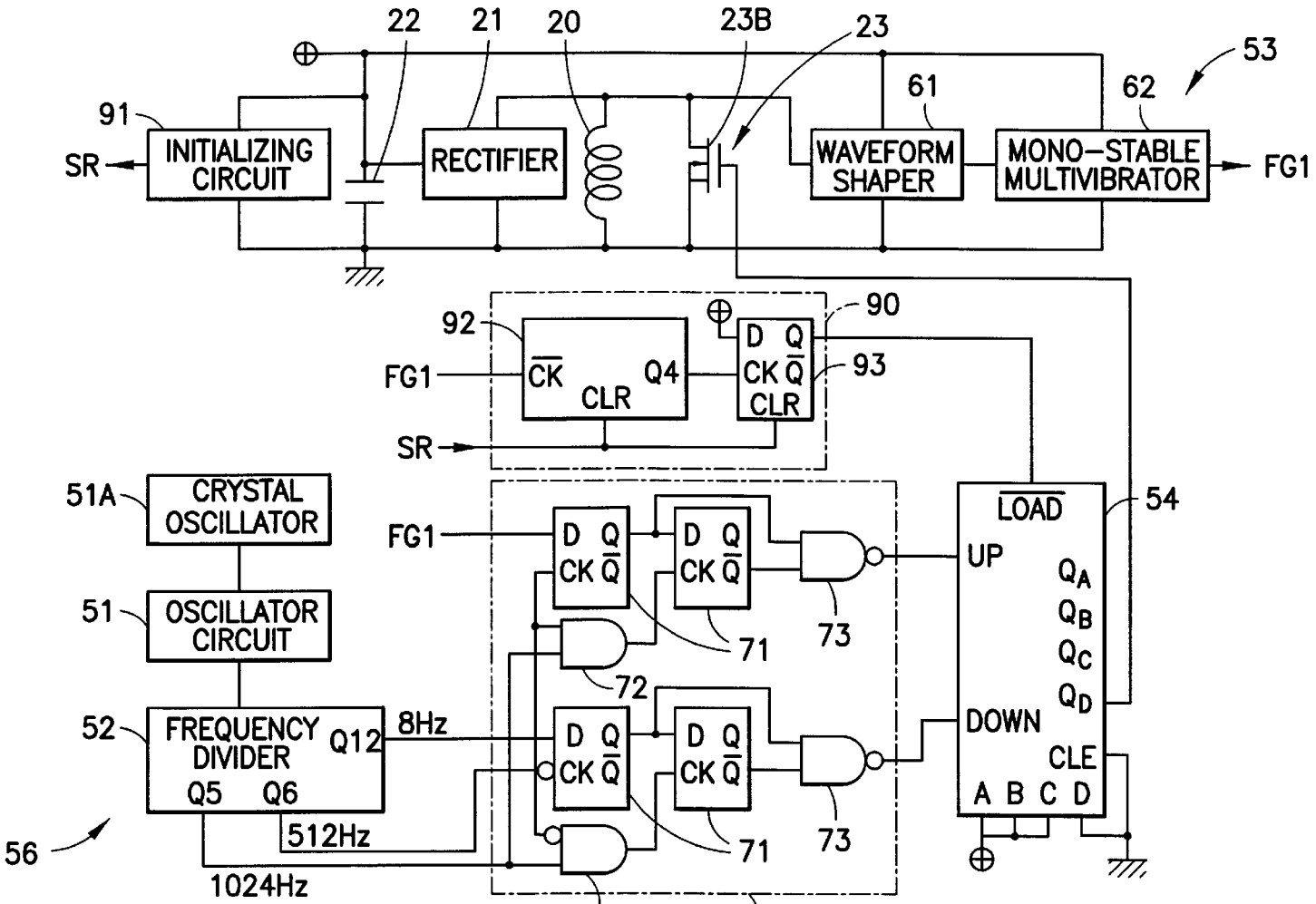
FIG. 5 is a schematic diagram of the timepiece constructed in accordance with the first embodiment of the invention.

Referring to FIGS. 4 and 5, the control circuit of timepiece 25 is now discussed. FIG. 4 is a block diagram showing timepiece 25 of the first embodiment of the present invention, while FIG. 5 is a schematic diagram of timepiece 25. An alternating current output from generator 20 is stepped up and rectified through a rectifier 21, which may include a step-up rectifier, a full-wave rectifier, a half-wave rectifier, a transistor rectifier or the like, and is fed to a capacitor 22, which acts as a power supply.

Referring to FIG. 5, timepiece 25 includes a brake circuit 23, which includes a transistor 23B as a switching element, and is connected to generator 20. Generator 20 is governed by controlling brake circuit 23, which is preferably designed to take into consideration the parasitic diode of transistor 23B.

Timepiece 25 also includes a rotation controller 50 that includes an oscillator circuit 51, inputting a clock to a frequency divider 52. A rotation detector 53 for detecting the rotation of rotor 12 and outputs a signal in response thereto. A first counter 54A counts the output of frequency divider 52 and a second counter 54B counts the output of rotation detector 53. A comparator 54C compares the outputs of counters 54A, 54B and provides an output to a brake control circuit 55. In this embodiment, first counter 54A, second counter 54B, comparator 54C and brake control circuit 55 are constructed as an up/down counter 54.

Oscillator circuit 51 outputs an oscillation signal (32768 Hz) inputted from a crystal oscillator 51A as a time reference source. The oscillation signal is frequency-divided to a signal having a predetermined period by frequency divider 52, which has twelve stages of flip-flops. The divided signal is the output to the first counter 54A as an 8-Hz reference signal fs. Oscillator circuit 51 and frequency divider 52 form reference signal generator 56.

Referring to FIGS. 4 and 5, rotation detector 53 includes a waveform shaper 61 connected to generator 20 and a monostable multivibrator 62. Waveform shaper 61 includes an amplifier and a comparator, and converts a sinusoidal wave signal into a rectangular wave signal. Monostable multivibrator 62 works as a bandpass filter that passes pulses having a period longer than a certain value, and outputs a rotation signal FG1 with noise filtered out therefrom.

As shown in FIG. 5, rotation signal FG1 from rotation detector 53 and the reference signal fs from frequency divider 52 are respectively input to an up count input and a down count input of up/down counter 54 via a synchronizing circuit 70.

Synchronizing circuit 70 includes four flip-flops 71 that provide inputs to AND gates 72 and NAND gates 73, respectively. Synchronizing circuit 70 synchronizes rotation signal FG1 with reference signal fs (8 Hz) using the output from the fifth stage (1024 Hz) of frequency divider 52 and the output from the sixth stage (512 Hz) of frequency divider 52 and adjusts the pulses of these signals so that they are not output at the same time.

Up/down counter 54 is a 4-bit counter and receives, at its up count input, a signal based on rotation signal FG1 from synchronizing circuit 70, and receives, at its down count input, a signal based on reference signal fs from synchronizing circuit 70. With this arrangement, up/down counter 54 concurrently counts reference signal fs, rotation signal FG1 (at what are functionally indicated as first counter 54A and second counter 54B in FIG. 4) and the difference between the two counts (functionally indicated as comparator 54C in FIG. 4).

Referring to FIG. 5, up/down counter 54 is provided with four input terminals (preset terminals) A through D. Terminals A through C are pulled up to a high level, setting the initial value (preset value) of up/down counter 54 at "7".

A startup and initializing circuit 90 is connected to the load input of up/down counter 54. Startup and initializing circuit 90 includes an initializing circuit 91, connected to capacitor 22, for outputting a system reset signal SR when power is initially fed to capacitor 22, a frequency divider 92, which is reset by system reset signal SR, for counting a predetermined number of pulses of rotation signal FG1, and a flip-flop 93, which is also reset by system reset signal SR, for receiving the clock signal from frequency divider 92.

Frequency divider 92 includes four stages of flip-flops, and outputs a high-level signal upon receiving sixteen pulses of rotation signal FG1. After receiving sixteen pulses of rotation signal FG1 from the input of system reset signal SR, flip-flop 93 outputs a high-level signal to the load input of up/down counter 54. Up/down counter 54 does not accept the up and down inputs until the transition of the load input to a high-level signal for flip-flop 93. During this period, up/down counter 54 is maintained at the count of "7".

Up/down counter 54 is provided with four-bit outputs QA–QD. The fourth bit output QD outputs a low-level signal when the count is "7" or lower, and outputs a high-level signal when the count is "8" or higher. Output QD of up/down counter 54 is connected to the gate of N-channel transistor 23B in brake circuit 23, which is connected in parallel with generator 20. When output QD transmits a high-level signal to the gate of the transistor 23B, transistor 23B is activated, shorting generator 20 and thereby applying a brake on generator 20.

When output QD transmits a low-level signal, the gate voltage of transistor 23B drops, deactivating transistor 23B, and generator 20 is not braked. Since brake circuit 23 is controlled by output QD of up/down counter 54, up/down counter 54 also works as brake control circuit 55, functionally represented in FIG. 4.

Figure 6:
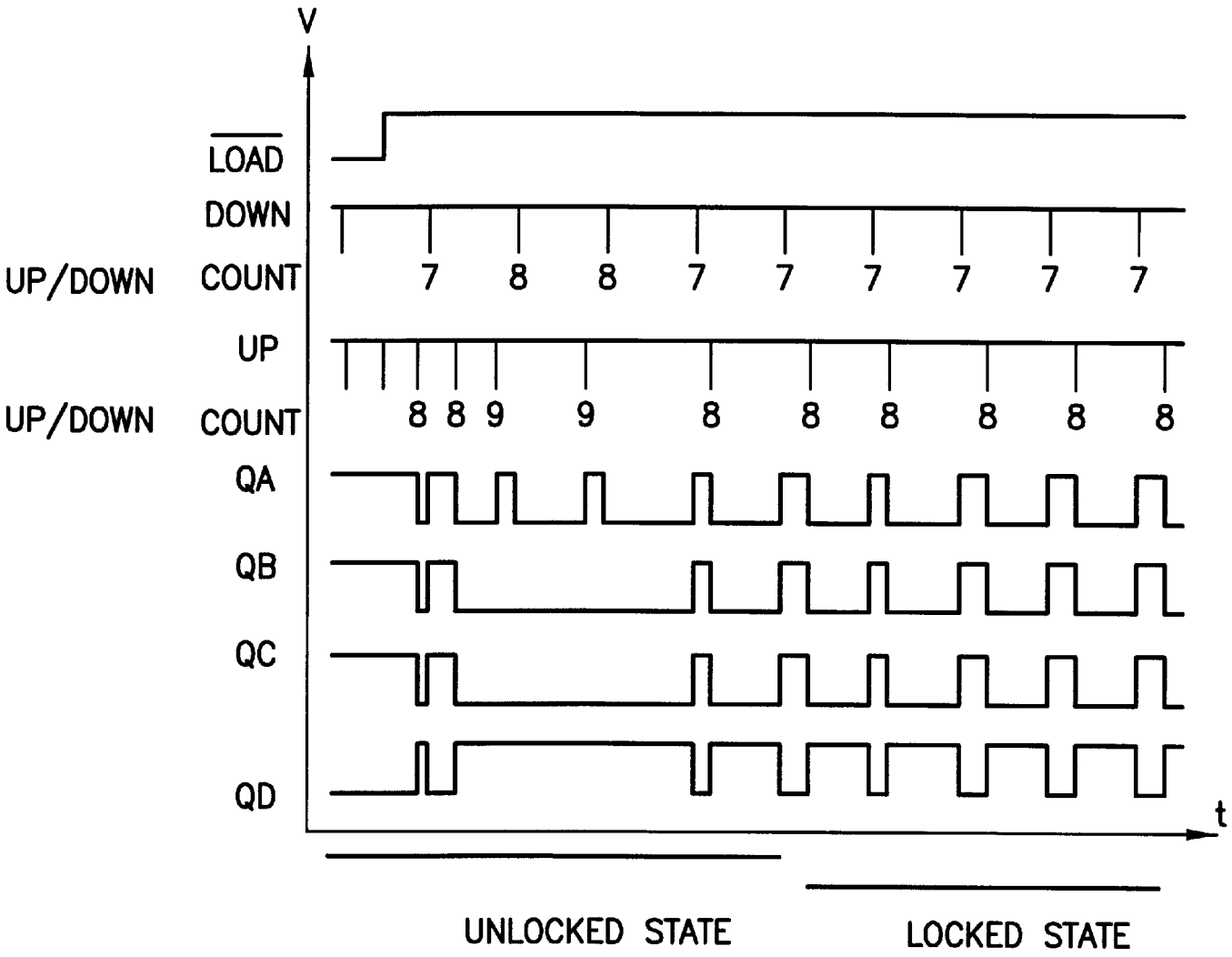
FIG. 6 is a timing diagram of the operation of the timepiece constructed in accordance with the first embodiment of the invention.
Figure 7:
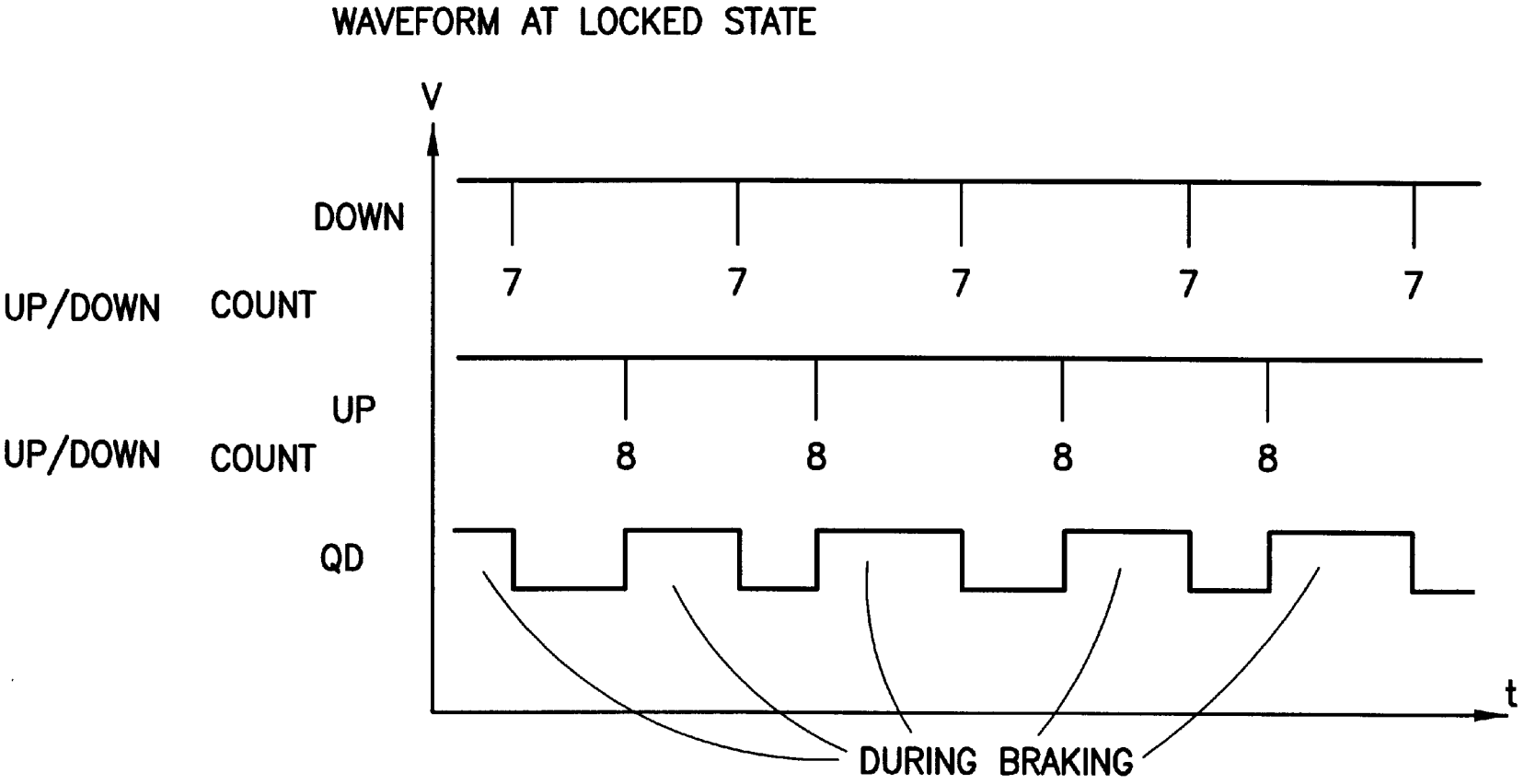
FIG. 7 is a timing diagram of the operation of the timepiece constructed in accordance with the first embodiment of the invention.
Figure 8:
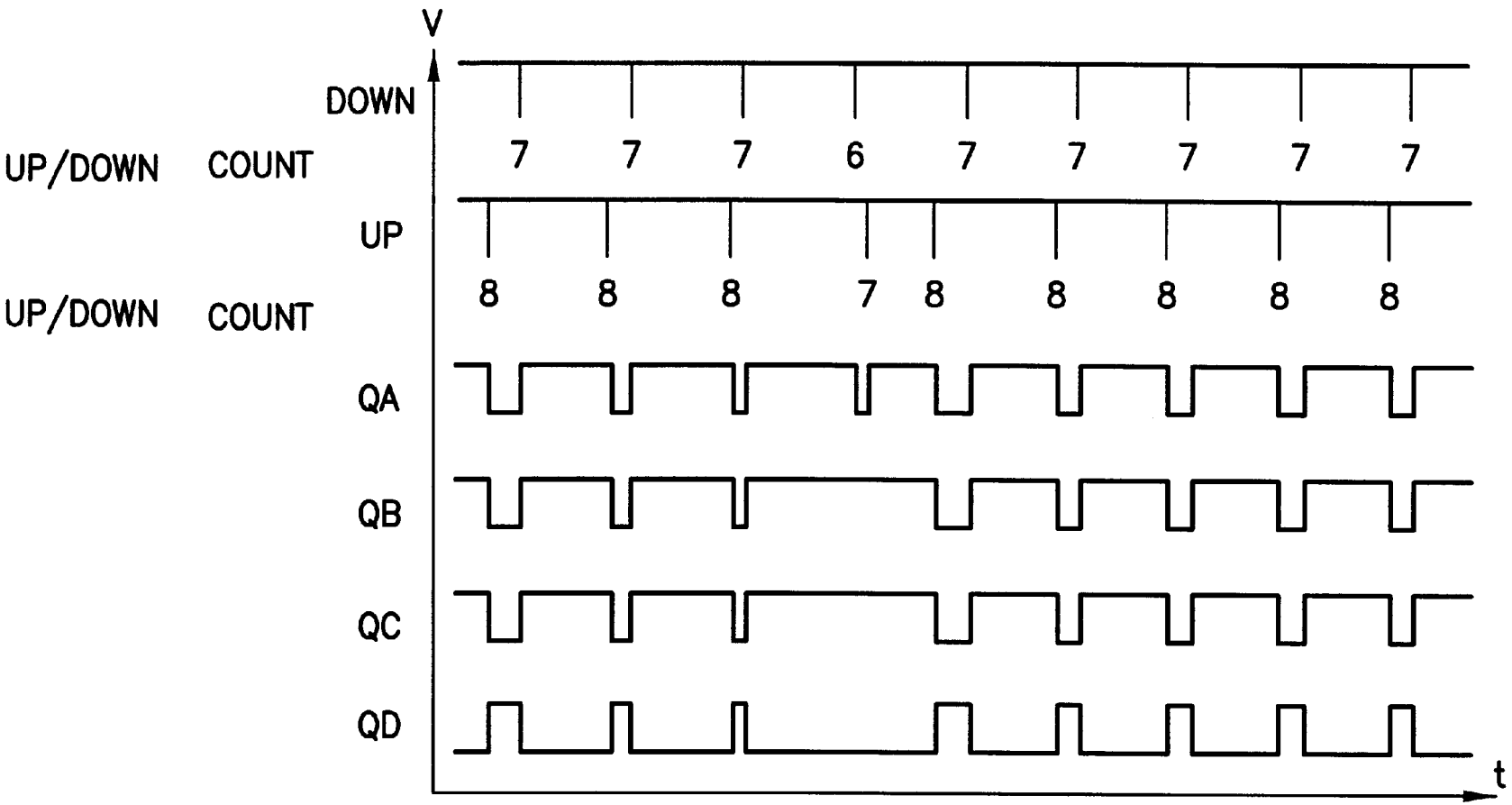
FIG. 8 is a timing diagram of the operation of the timepiece constructed in accordance with the first embodiment of the invention.
Figure 9:
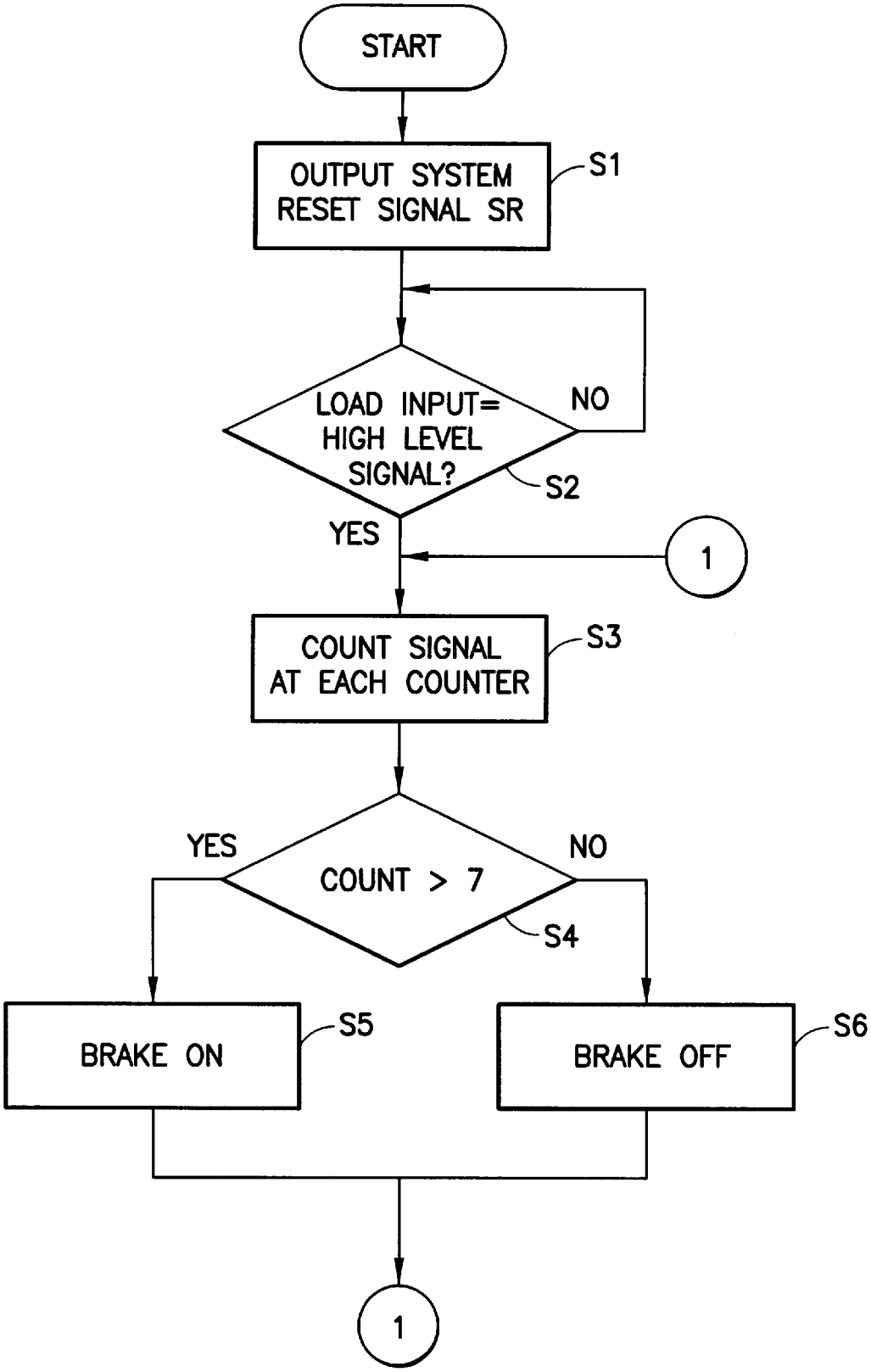
FIG. 9 is a flow diagram showing the control method of the timepiece constructed in accordance with the first embodiment of the invention.

The operation of this embodiment is now discussed referring to timing diagrams shown in FIGS. 6 through 8 and a flow diagram shown in FIG. 9 depicting each of the steps. When generator 20 is activated, the system reset signal SR is output in Step 1 or S1 (hereinafter Step is simply referred to as "S"). After a predetermined time elapse, startup and initializing circuit 90 inputs a high-level signal to the load input of up/down counter 54 (S2). As shown in FIG. 6, up/down counter 54 counts the up count input signal based on rotation signal FG1 and the down count input signal based on reference signal fs (S3). Synchronizing circuit 70 adjusts these signals so that they are not concurrently input to up/down counter 54.

The preset count "7" is changed to "8" when an up count input signal is fed. Output QD gives a high-level signal to transistor 23B in brake circuit 23 (S4) whereupon a brake is applied to generator 20 (S5). If a down count input signal is fed, the count returns to "7", output QD transmits a low-level signal (S4), and a brake is applied to generator 20 (S6).

When the torque of mainspring 1*a* becomes large enough to rotate generator 20 at a high rotational speed, an up count input signal is further input even after the count is incremented to "8". In such a case, the count becomes "9", and output QD remains at a high level, leaving a brake applied. With the brake continuously applied, the rotational speed of the generator 20 drops. If the reference signal fs (the down count input signal) is input twice before the input of rotation signal FG1, the count drops to "8", and then to "7". At the moment the count drops to "7", the brake is released.

In such a brake control, generator 20 reaches a set rotational speed, and the up count input signal and the down count input signal are alternately input to up/down counter 54, causing the count to alternate between "8" and "7" in a locked state as shown in FIG. 7. In response to the count, the brake is alternately activated and deactivated repeatedly.

Mainspring 1*a* is thereby unwound, outputting a smaller torque, and the time during which the brake is activated is gradually shortened as shown in FIG. 8. As such, the rotational speed of the generator 20 becomes close to the reference speed even without the application of a brake.

With no brake applied at all, the down count input signal is more frequently input. When the count drops to a value of "6" or smaller, the torque of the mainspring 1*a* is diminished. The hand is thus motionless or moves at a very slow speed. In this event, a buzzer may be sounded, or a light may be lit to urge the user to tighten mainspring 1*a*.

This embodiment has the following advantages:

(1) The up count input signal based on rotation signal FG1 and the down count input signal based on reference signal fs are input to up/down counter 54. When the count of FG1 (up count input signal) is greater than the count of the reference signal fs (down count input signal), namely, when the count is "8" or greater with the preset count at "7" in up/down counter 54, brake circuit 23 continuously applies a brake on generator 20. When the count of the rotation signal FG1 is equal to or smaller than the count of the reference signal fs (when the count is "7" or smaller), the brake on generator 20 is released. With this arrangement, generator 20 quickly becomes close to the reference speed under fast response rotation control even when the rotational speed of generator 20 substantially deviates from the reference speed, for example, at startup.

(2) Since brake control depends on whether the count is "7" or smaller, or "8" or greater, there is no need for setting a separate braking time. Thus, the construction of rotation controller 50 is simple and effective, reducing component cost and manufacturing cost, and thereby resulting in a low-cost, electronically-controlled, mechanical timepiece.

(3) The duration of count "8", namely, the period within which a brake is applied, is automatically adjusted because the timing of the up count input signal is varied depending on the rotational speed of generator 20. For this reason, fast and stable response control is performed, particularly in the locked state wherein the up count input signal and the down count input signal are alternately input.

(4) Counting and comparing the count outputs (to determine the difference therebetween) are concurrently performed since up/down counter 54 is used as the counter. This arrangement readily computes the difference between the counts and is a simple construction compared with the construction in which a first counter and a second counter are separately arranged with a comparator attached for comparing the count outputs from the counters.

(5) The 4-bit up/down counter 54 counts up to sixteen. When the up count input signal is repeatedly input, the inputs are cumulatively counted. Within a set range, preferably, a range over which the count rises to "15" or falls to "0", a cumulative error is corrected when the up count input signal or the down count input signal successively input. Even if the rotational speed of generator 20 substantially deviates from the reference speed, generator 20 reverts back to the reference speed with the cumulative error reliably corrected, even though it takes time for up/down counter 54 to reach the locked state. This control proves effective in maintaining accurate timekeeping.

(6) Startup and initializing circuit 90 does not perform brake control at the startup of generator 20 and thus no brake is applied to generator 20. Thus, at startup, charging capacitor 22 is prioritized. As a result, rotation controller 50, driven by capacitor 22, works smoothly and reliably, heightening the reliability of subsequent rotation control.

Figure 10:
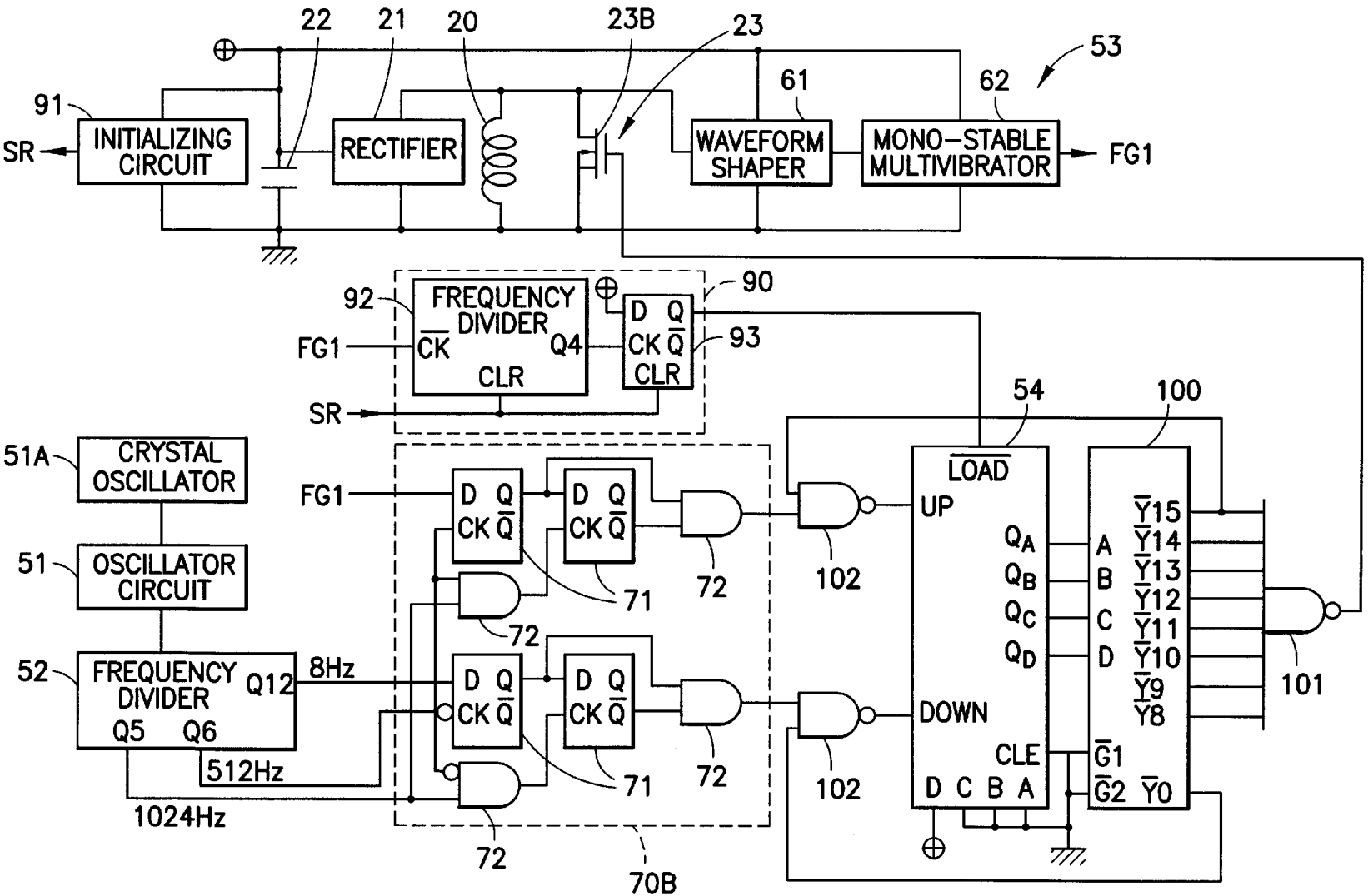
FIG. 10 is a schematic diagram showing a timepiece constructed in accordance with the second embodiment of the invention.

Referring to FIG. 10, a timepiece constructed in accordance with second embodiment of the invention is now discussed. Like numerals are used to indicate like structure. In the second embodiment, a line decoder 100 is connected to the output side of the up/down counter 54. Outputs Y8–Y15, respectively corresponding to counts "8"–"15" of the up/down counter 54, are input to transistor 23B in brake circuit 23 via a NAND gate 101. Line decoder 100 outputs a low-level signal at outputs Y0–Y7, while the remaining outputs, Y8–Y15, transmit signals at a high level. When one of outputs Y8–Y15 is selected, namely, when the count of up/down counter 54 is one of "8" through "15", a high-level signal is input to the gate of transistor 23B. Conversely, when the count is "7" or smaller, a low-level signal is input to the gate of transistor 23B.

Outputs Y0 and Y15 of line decoder 100 are input to respective NAND gates 102 to which the outputs of the synchronizing circuit 70 are also applied. When the up count input signal is fed a plural number of times causing the count to rise to "15", if, at that point, a further up count input signal is input to NAND gate 102, the input is canceled, and no further up count input signal is input to up/down counter 54. In this way, the count is prevented from shifting from "15" to "0", or shifting from "0" to "15". In the second embodiment, the initial value of up/down counter 54 is set to count "8".

The second embodiment has the same advantages as those of the first embodiment, stated above. The second embodiment presents the following additional advantage:

(7) Line decoder 100 is provided so that the outputs Y0–Y15, corresponding to the counts "0"–"15", are fed back to NAND gates 102. The count is prevented from shifting "15" to "0", or shifting from "0" to "15", even if the up count input signal or the down count input signal is input in succession. When a cumulative error becomes large in magnitude, a determination of whether the error is in the direction of lead or lag is quickly made, and erratic control is avoided.

Referring to FIGS. 11–15, a timepiece constructed in accordance with a third embodiment of the invention is now discussed. Components identical or equivalent to those described in connection with the first embodiment are designated with the same reference numerals.

Figure 11:
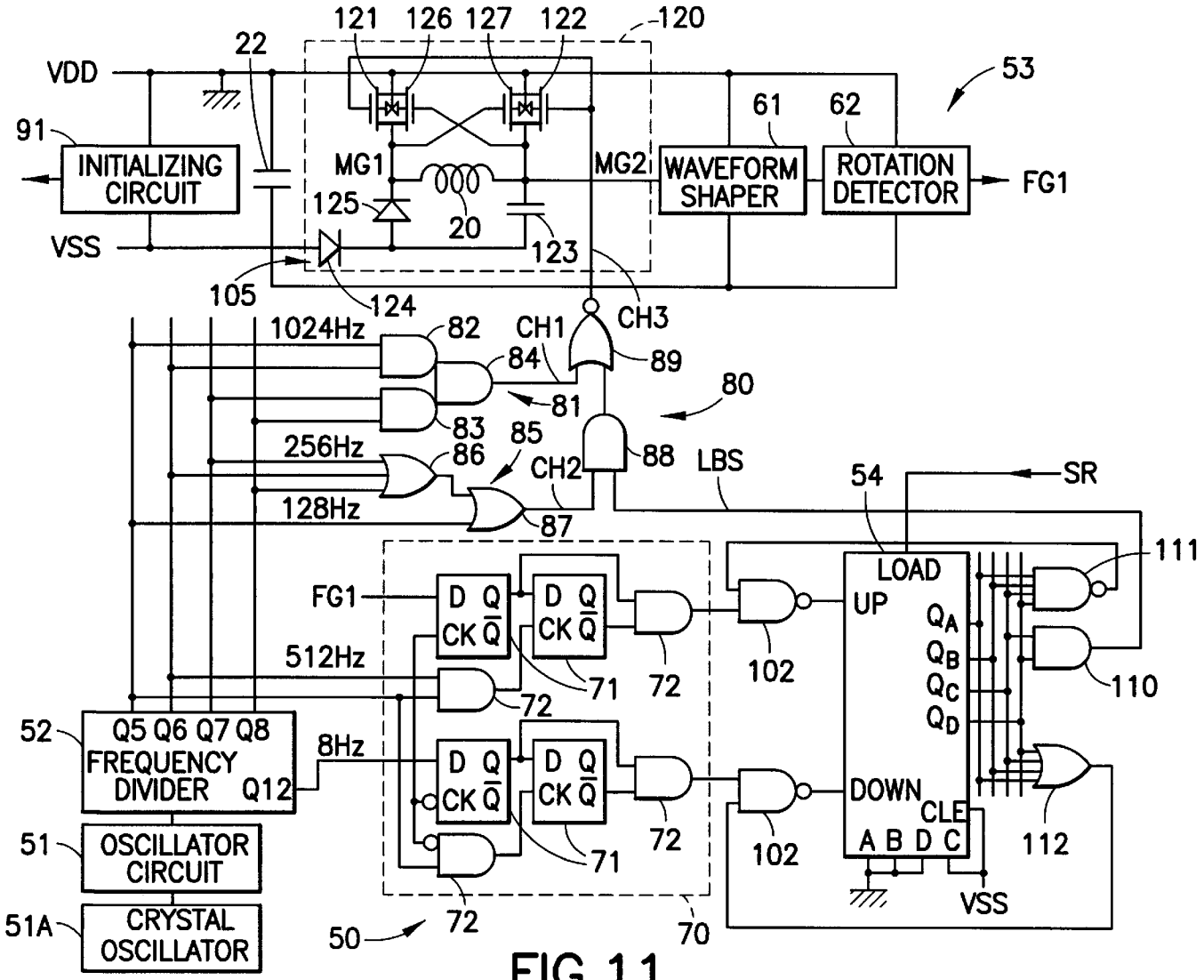
FIG. 11 is a schematic diagram showing a timepiece constructed in accordance with third embodiment of the invention.

As is shown in FIG. 11, generator 20 is provided with a brake circuit 120 that includes a rectifier 105, coupled to switches 121 and 122 connected at a respective output of generator 20 for shorting output terminals MG1 and MG2 of generator 20 for braking control purposes. In this third embodiment, switches 121 and 122 are preferably P-channel transistors. The voltage doubler rectifier 105 is constructed of a capacitor 123 connected to generator 20, diodes 124, 125, and switching transistors 126 and 127.

As in the preceding embodiments, brake circuit 120 is controlled by rotation controller 50 which is operated from power supplied by the power supply, capacitor 22. In this embodiment, brake control circuit 155 includes up/down counter 54, synchronizing circuit 70 and a chopper signal generator 80.

Up/down counter 54 receives, at its up count input, rotation signal FG1 of rotation detector 53 and, at its down count input, reference signal fs from frequency divider 52, via synchronizing circuit 70. Up/down counter 54 is preferably a 4-bit counter as in the preceding embodiments. Out of the four data input terminals (preset terminals) A–D of up/down counter 54, a high-level is input to terminals A, B and D. The initial value (preset value) of up/down counter 54 is preferably set to "11".

Figure 12:
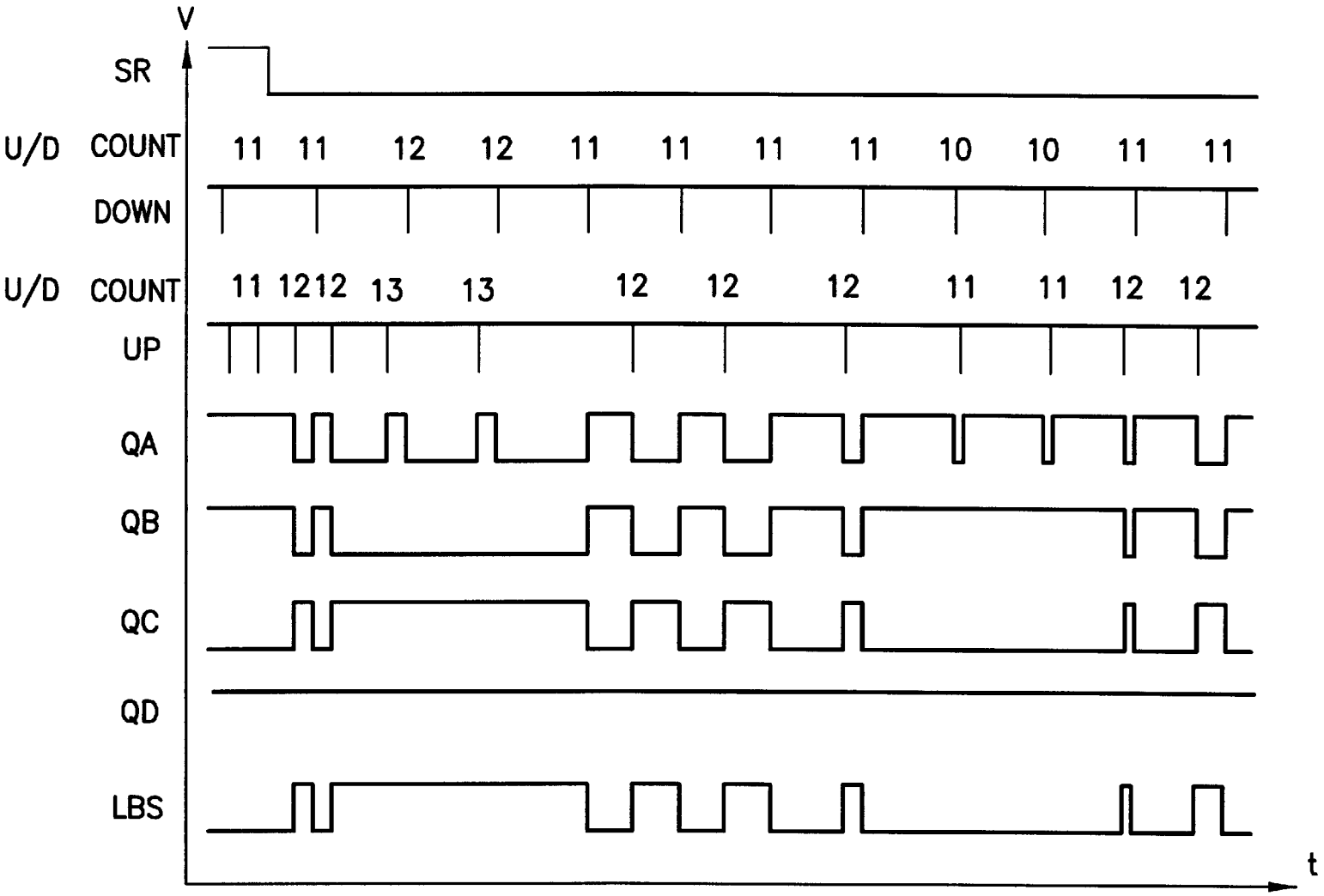
FIG. 12 is a timing diagram of the operation of the timepiece constructed in accordance with the third embodiment of the invention.

Up/down counter 54 accepts no up/down count input signals until the load input, namely, the system reset signal SR, turns low. Until that time, up/down counter 54 remains on the count of "11" as shown in FIG. 12.

Up/down counter 54 has four bit outputs of QA–QD. When the count is "12" or higher, both third bit output QC and fourth bit output QD transmits a high-level signal. When the count is "11" or lower, at least one of third bit output QC and fourth bit output QD transmit a low-level signal.

The output LBS of an AND gate 110, to which outputs QC and QD are input, is a high-level signal when up/down counter 54 gives the count of "12" or higher, and is a lowlevel signal when up/down counter 54 gives the count of "11" or lower. Output LBS is connected to chopper signal generator 80.

The outputs of a NAND gate 111 and an OR gate 112, each receiving the outputs QA–QD, are input to each NAND gate 102, to which the outputs of the synchronizing circuit 70 are also input. When the up count input signal is repeatedly input causing the count to reach "15", NAND gate 111 outputs a low-level signal. Then, if an additional up-count signal is input to NAND gate 102, the input is canceled, and no additional up-count signal is input to up/down counter 54. Similarly, when the count reaches "0", OR gate 112 outputs a low-level signal, and a further down-count signal is canceled. In this manner, as in the second embodiment, the count is prevented from shifting "15" to "0", or shifting from "0" to "15".

Chopper signal generator 80 includes first chopper signal generator 81, constructed of three AND gates 82–84, for outputting a first chopper signal CH1 based on outputs Q5–Q8 of frequency divider 52, a second chopper signal generator 85, constructed of two OR gates 86 and 87, for outputting a second chopper signal CH2 based on outputs Q5–Q8 of frequency divider 52, an AND gate 88 for receiving output LBS of up/down counter 54 and output CH2 of second chopper signal generator 85, and a NOR gate 89 for receiving the output of AND gate 88 and output CH1 of first chopper signal generator 81.

The output CH3 of NOR gate 89 in chopper signal generator 80 is input to the gates of switches 121 and 122, which are preferably P-channel transistors. When output CH3 is a low-level signal, switches 121 and 122 are activated, thereby shorting generator 20 for braking. When output CH3 is a high-level signal, switches 121 and 122 are deactivated, applying no brake on generator 20. The chopper signal from output CH3 thus controls generator 20 in chopping control.

Figure 13:
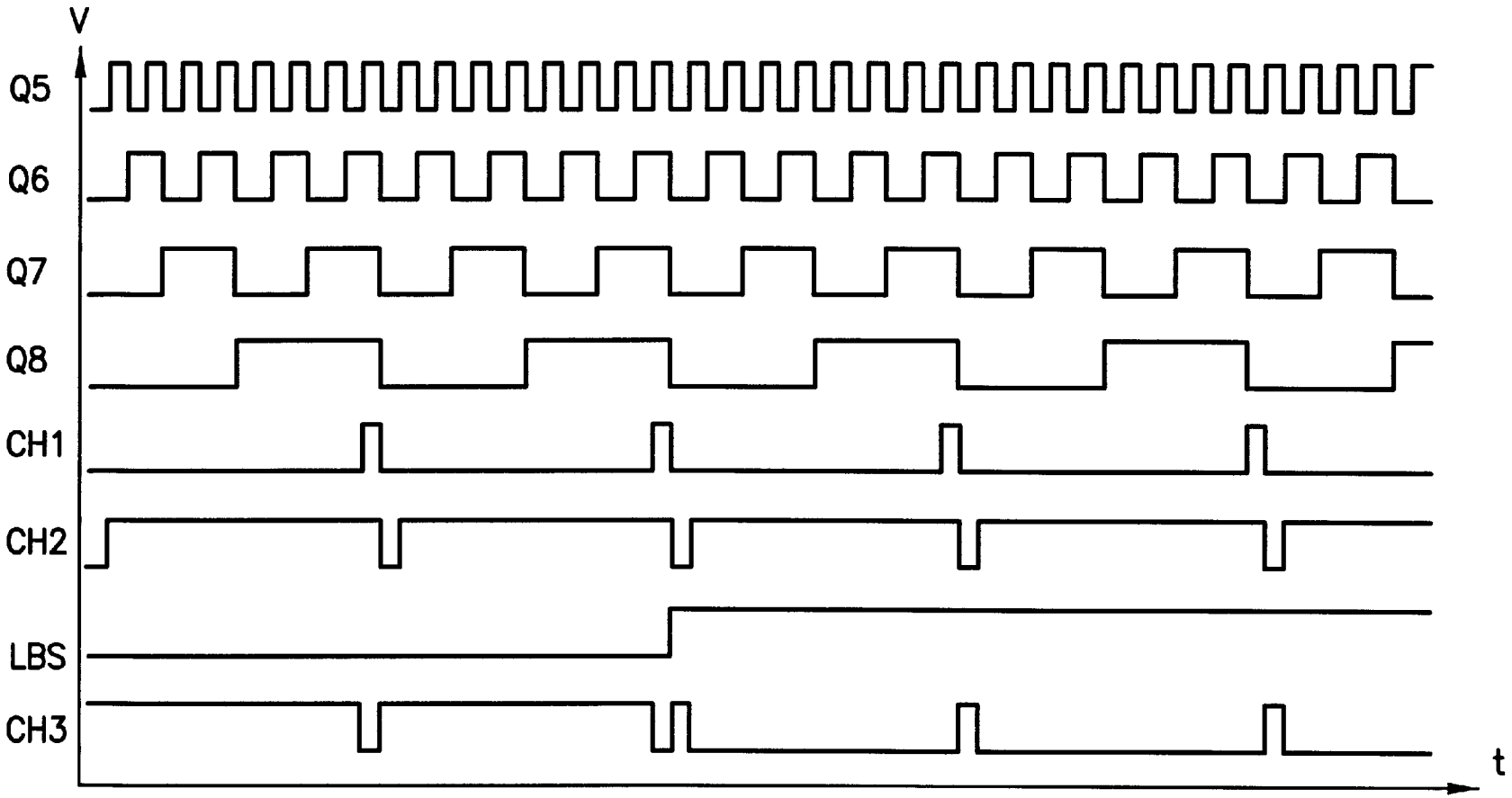
FIG. 13 is a timing diagram of the operation of the timepiece constructed in accordance with the third embodiment of the invention.
Figure 14:
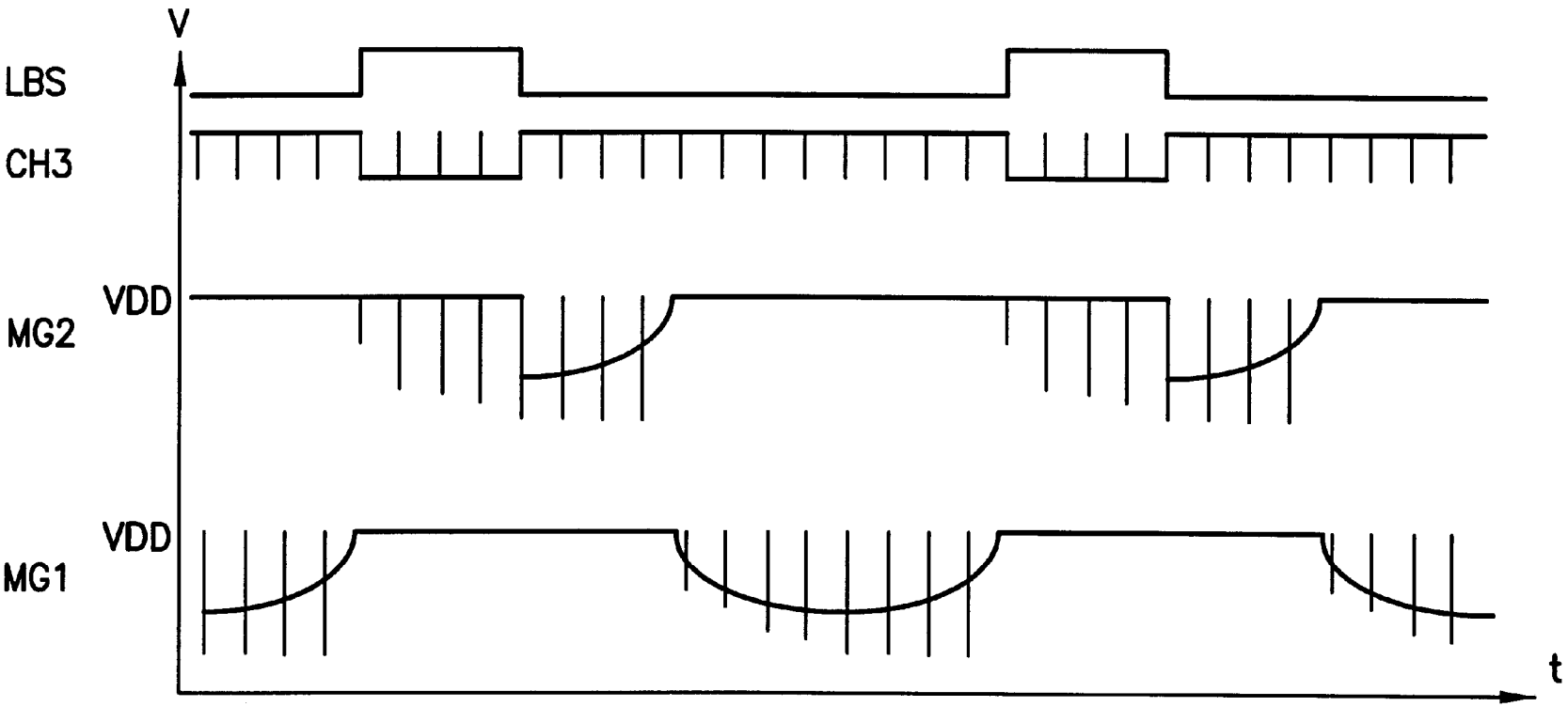
FIG. 14 is a timing diagram of the operation of the timepiece constructed in accordance with the third embodiment of the invention.
Figure 15:
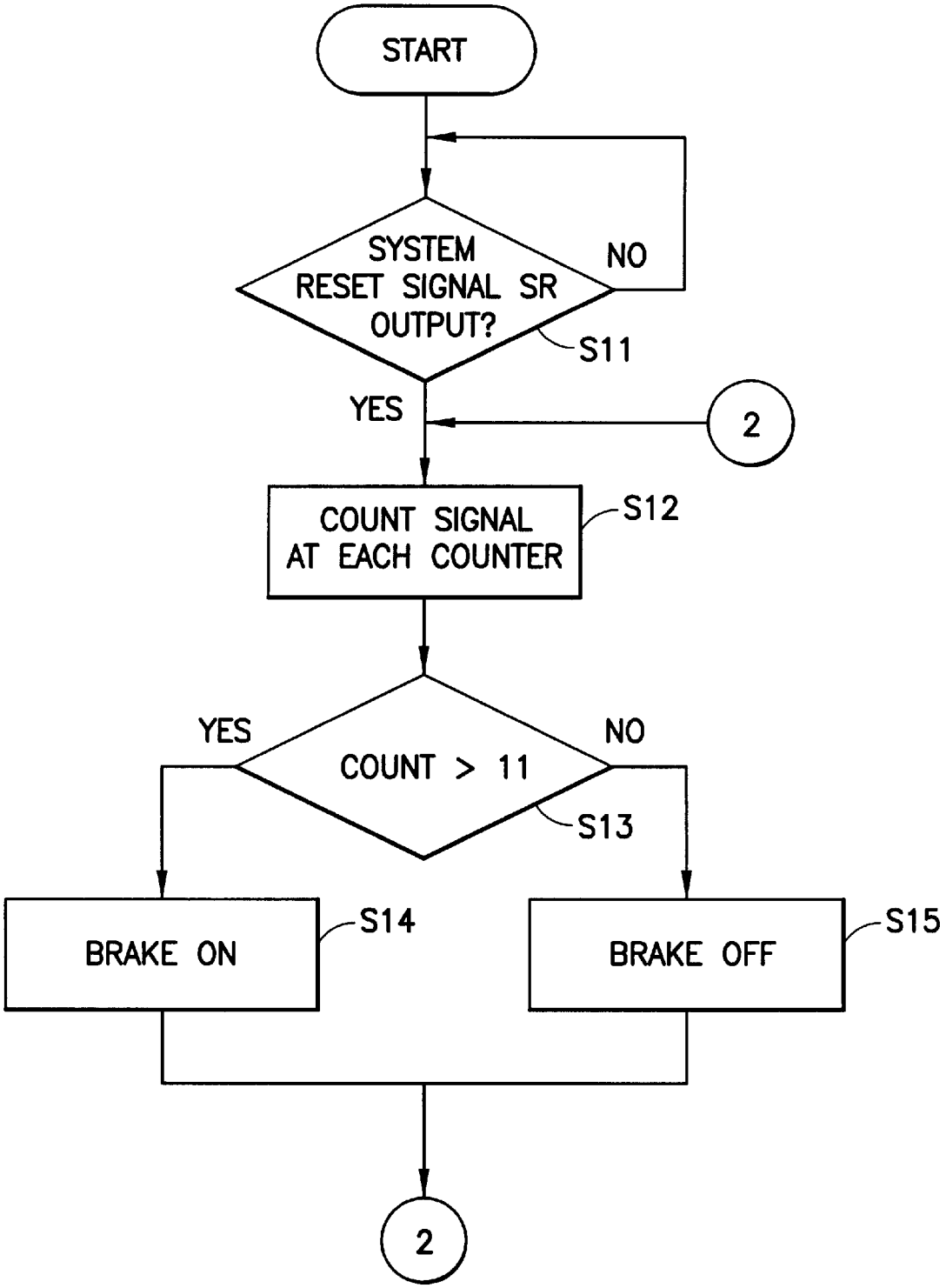
FIG. 15 is a flow diagram the operation of the timepiece constructed in accordance with the third embodiment of the invention.

The operation of the third embodiment is discussed referring to timing diagrams shown in FIGS. 12–13, an output waveform diagram shown in FIG. 14, and a flow diagram shown in FIG. 15, which depicts each of the steps designated S11 through S15.

When generator 20 starts operating, causing initializing circuit 91 to output low-level system reset signal SR to the load input of up/down counter 54 (S11), the up-count signal based on rotation signal FG1 and the down-count signal based on reference signal fs are input to up/down counter 54 (S12), as shown in FIG. 12. These signals are adjusted through synchronizing circuit 70 so that they are not concurrently input to up/down counter 54.

When the up-count signal is input when the initial count is set to "11", the count is shifted to "12", output LBS is driven high, and is output to AND gate 88 in chopper signal generator 80. When the down-count signal is input, causing the count to return to "11", output LBS is driven low.

In chopper signal generator 80, first chopper signal generator 81 transmits output CH1 and second chopper signal generator 85 transmits output CH2, based on outputs Q5–Q8 of frequency divider 52.

When up/down counter 54 outputs a low-level output LBS (with the count at "11" or lower), the output of AND gate 88 is also at a low level. Output CH3 of NOR gate 89 is a chopper signal, which is an inversion of output CH1, having a duty factor (the ratio of activation time of switch 121 to that of switch 122) of a long high-level duration (brake deactivation time) and a short low-level duration (brake activation time). As such, the brake-activation time of the reference period becomes short, and for practical purposes, no brake is applied to generator 20. Specifically, when the count is "11" or lower, the brake-deactivation control is performed with a priority placed on power generation (S13 and S15).

When up/down counter 54 outputs a high-level output LBS (with the count at "12" or higher), the output of AND gate 88 is also at a high level. Output CH3 of NOR gate 89 is a chopper signal, which is an inversion of output CH2, having a duty factor of a long low-level duration (brake-activation time) and a short high-level duration (brake-deactivation time). The brake-activation time of the reference period becomes long, and the brake-activation control is performed on generator 20. However, brake-deactivation is repeated at regular intervals, permitting chopper control, in which a reduction in generated power is controlled while braking torque is increased (S13 and S14).

When the torque of mainspring 1*a* is large enough to rotate generator 20 at a high rotational speed, a further up-count signal may be fed even after the up-count-signal rises to the count of "12". In such a case, the count rises to "13", and output LBS remains at a high level. The brake-activation control is thus performed in which a brake is applied while being turned off at regular intervals. With a brake applied, the rotational speed of generator 20 drops. If reference signal fs (the down-count signal) is input twice before the entry of rotation signal FG1, the count drops to "12", and then to "11". At the moment the count drops to "11", the brake-deactivation control is commenced, releasing the brake.

In such a brake control, generator 20 reaches a set rotational speed, and the up-count signal and the down-count signal are alternately input to the up/down counter 54, causing the count to alternate between "12" and "11" in a locked state as shown in FIG. 12. In response to the count, the brake-activation and brake-deactivation are alternately repeated. Specifically, in one reference period during which the rotor makes one revolution, the chopper signal having a large duty factor and the chopper signal having a small duty factor are fed to switches 121 and 122 to perform chopper control.

In this manner, the watch operation continues until mainspring 1*a* is unwound, outputting a smaller torque, and brake activation is gradually shortened. Thus, rotational speed of generator 20 becomes close to the reference speed even when no brake is applied. With no brake applied at all, the down-count signal is more frequently input. The count drops to a value of "10" or smaller, and the torque of mainspring 1*a* is regarded as diminished. The hand is thus motionless or left moving at a very slow speed. A buzzer may be sounded, or a light may be lit to urge the user to tighten mainspring la.

While up/down counter 54 outputs a high-level LBS signal, the brake-activation control is performed using the chopper signal having a large duty factor. While up/down counter 54 outputs a low-level LBS signal, the brake-deactivation control is performed using the chopper signal having a small duty factor. Specifically, up/down counter 54 acts to control the brake by switching between the brake-activation control and the brake-deactivation control.

In the third embodiment, during the output of a low-level LBS signal, the duty factor of output CH3 chopper signal is preferably 15:1 (high-level duration:low-level duration), namely, $1/16=0.0625$. During the high-level LBS signal, the duty factor of CH3 chopper signal is preferably 1:15 (high-level duration:low-level duration), namely, $15/16=0.9375$.

Referring to FIG. 14, generator 20 outputs, across MG1 and MG2, an alternating current in accordance with the change in magnetic flux. Depending on output LBS signal, chopper signals CH3 at a constant frequency but different duty factors are fed to switches 121 and 122. When the high-level LBS signal is output, namely, during the brake-activation control, the braking time in each chopper cycle is lengthened, thereby increasing the braking and reducing the rotational speed of generator 20. As the brake is applied, generated power is reduced, accordingly. However, energy accumulated during the braking is output when the chopper signal deactivates switches 121 and 122, and is used to step up the output voltage of the generator 20. In this way, a reduction in generated power during the braking is compensated for. The braking torque is thus increased while the reduction in generated power is restricted.

When the low-level LBS signal is output, namely, during the brake-deactivation control, the braking time in the chopper cycle is shortened, increasing the rotational speed of generator 20. In this case, also, the chopper signal activates and deactivates switches 121 and 122, and chopper voltage step-up results. The generated power is large compared with the generated power when no brake applied at all.

The alternating current output of generator 20 is stepped up and rectified through the voltage doubler rectifier 105, and charges power supply (capacitor) 22, which in turn drives rotation controller 50.

Output LBS of up/down counter 54 and chopper signal CH3 are commonly based on outputs Q5–Q8 and Q12 of frequency divider 52. More specifically, the frequency of the chopper signal CH3 is an integer multiple of the frequency of the output LBS, and the change in signal level of output LBS, namely, a switch timing between the brake-activation control and the brake-deactivation control, takes place in synchronization with chopper signal CH3.

The third embodiment of the present invention provides the advantages numbered (1)–(5) and (7) of the preceding embodiments, and also provides the following advantages:

(8) When up/down counter 54 outputs a count of "12" or higher, namely, within a range of four counts from "12" to "15", a brake is applied. When up/down counter 54 outputs a count of "11" or lower, namely, within a range of twelve counts from "0" to "11", no brake is applied. In other words, the range of brake application is set to be narrower than the range of brake release in the count range of up/down counter 54. The cumulative correction range where the rotor rotation period is longer than the reference period is thus widened, permitting the reliable correction of cumulative error that is likely to take place when no brake is applied. The rotational speed of generator 20 is thus allowed to revert back to the reference speed.

Specifically, when the count is "12" or higher, a large torque of mainspring 1*a* reduces the possibility that transient factors such as mechanical variations give rise to the input of an up-count signal. When the brake is applied, it is unlikely that three or four pulses of the up-count signal are input consecutively. As such, generator 20 is reliably controlled even if the range of brake application is set to be as narrow as a four-count range. On the other hand, when no brake is applied, the torque of mainspring 1*a* is typically reduced. A transient factor, such as mechanical variations and an impact exerted on the watch, may cause the down count input signal to be input consecutively a plural number of times. Thus, in a preferred embodiment, a twelve-count range is set for the range of brake release, and even when the down count input signal is input consecutively a plural number of times, the cumulative value is stored and used to reliably correct the cumulative error.

(9) Since two types of chopper signals CH3 having different duty factors are used to perform the brake-activation control and the brake-deactivation control, the magnitude of braking (braking torque) is increased without lowering the charging voltage (generated voltage). Since the chopper signal having a large duty factor is used for controlling, particularly during the period when the brake is activated, the braking torque is increased while controlling a drop in the charging voltage. In this way, the reliability of the watch is maintained while an efficient brake control is attained at the same time. The timepiece thereby gains a long life.

(10) Since the chopper signal having a small duty factor is used for the chopper control during the time period when the brake is deactivated, the charging voltage is increased during the time when the brake is off.

(11) The change in the output level of output QD, namely, the switch timing between the brake-activation control and the brake-deactivation control, is synchronized with the transition of chopper signal CH3 from on to off. Impulses having a high-voltage component are regularly output in synchronization with chopper signal CH3 of generator 20. This output may be used as a watch error measurement pulse.

When output LBS and chopper signal CH3 are not synchronized with each other, generator 20 generates a high-voltage component when output LBS changes, independently of the constant-period chopper signal CH3. For this reason, the "impulses" in the waveform of the output voltage from generator 20 do not necessarily have a constant period, and are not appropriate for use as the watch error measurement pulse. However, if synchronization is assured as in this embodiment, the impulses may serve as the watch error measurement pulse.

Figure 16:
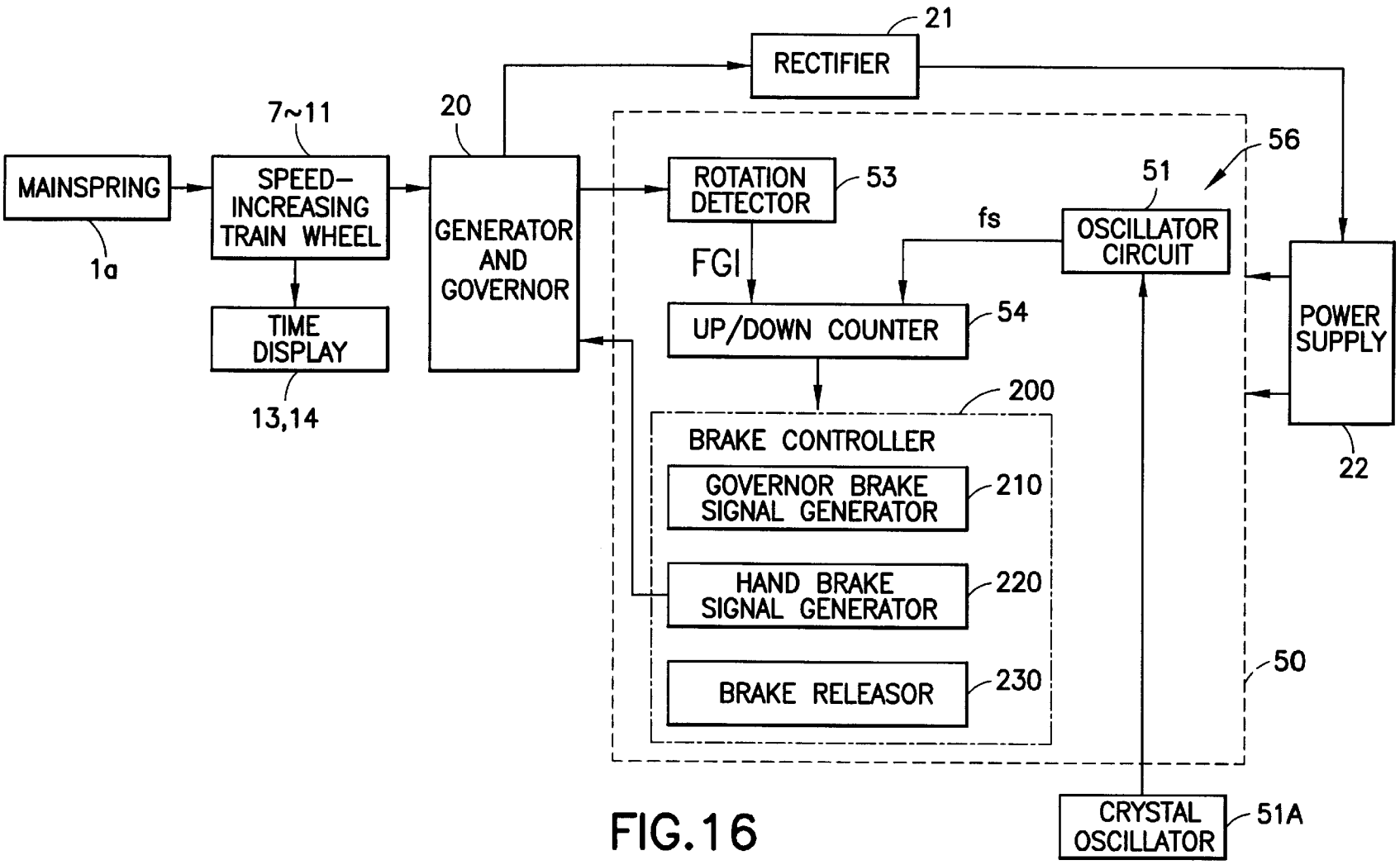
FIG. 16 is a block diagram showing a timepiece controller of a timepiece constructed in accordance with the fourth embodiment of the invention.
Figure 17:
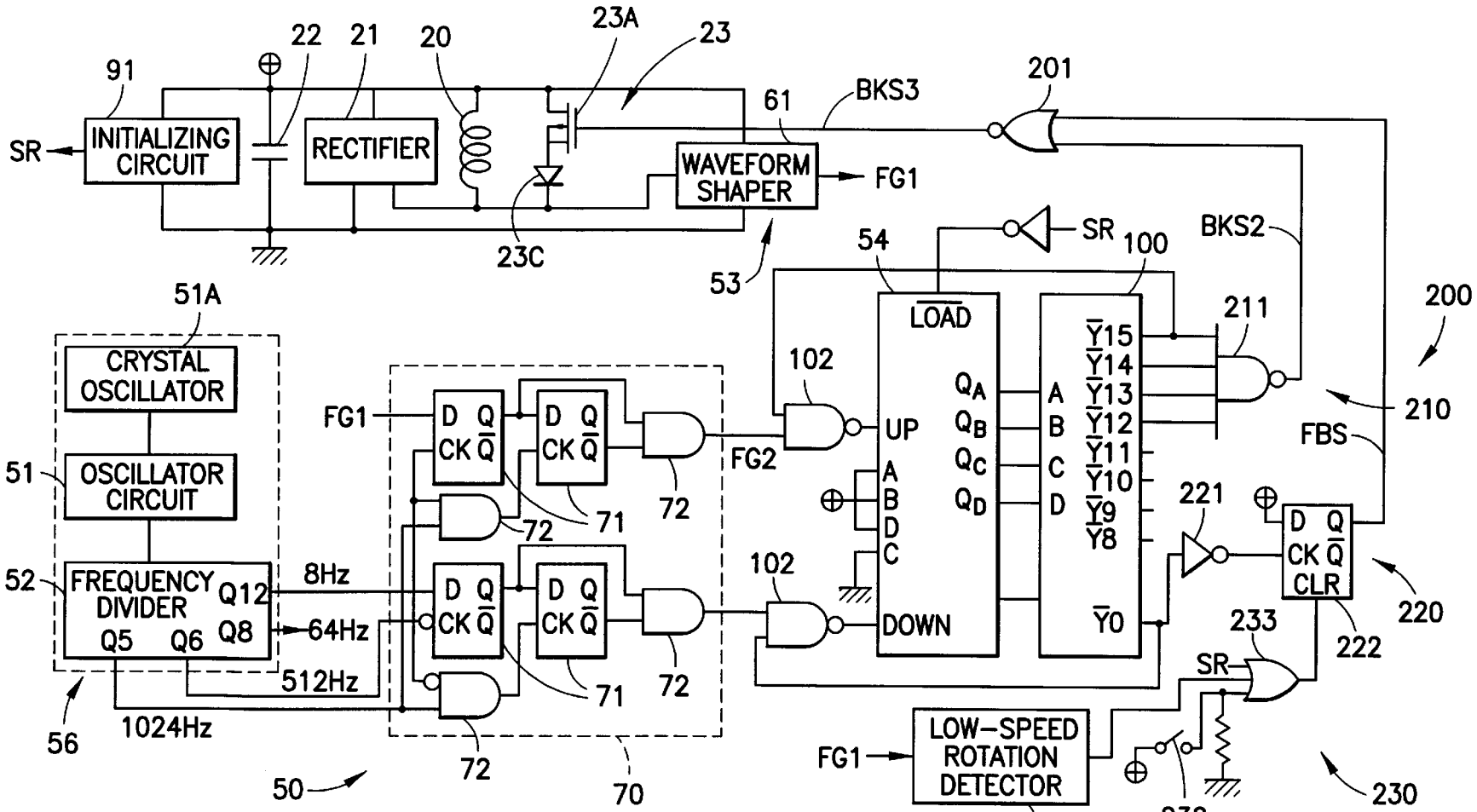
FIG. 17 is a schematic diagram of the timepiece constructed in accordance with the fourth embodiment of the invention.

A fourth embodiment of the present invention is now discussed. FIG. 16 is a block diagram of the electronically-controlled, mechanical timepiece of the fourth embodiment, and FIG. 17 is a schematic diagram of the watch. Components identical or equivalent to those described in connection with the first embodiment are designated with the same reference numerals.

As in the first embodiment, the electronically-controlled, mechanical timepiece includes mainspring 1*a* as a mechanical energy source, train wheels 7–11 for transmitting torque of mainspring 1*a* to generator 20, and hands (a minute hand and an hour hand, not shown) coupled to train wheels 7–11 for indicating the time.

Generator 20 is driven by mainspring 1*a* via train wheels 7–11, and generates an electromotive force to supply electrical energy. An alternating current output from generator 20 is rectified through rectifier 21 comprised of a step-up rectifier, a full-wave rectifier, a half-wave rectifier, a transistor rectifier, or the like, and is stepped up as required and fed to power supply 22, which includes a capacitor.

Referring to FIG. 17, a brake circuit 23, having a transistor 23A, which acts as a switching element, and a diode 23C, is connected to generator 20. The generator 20 is governed by controlling brake circuit 23 to short both terminals of generator 20. In brake circuit 23, diode 23C preferably has a small forward voltage. Brake circuit 23 is controlled by rotation controller 50 powered by power supply (capacitor) 22.

Referring to FIG. 16, the rotation controller 50 includes an oscillator circuit 51 for receiving a clock signal from a crystal oscillator 51A and outputting the fs signal in response thereto. A rotation detector 53 coupled to generator 20 outputs FG1. An up/down counter 54 receives fs and FG1 and provides a signal to brake controller 200. Oscillator circuit 51 outputs an oscillation signal (32768 Hz) from a crystal oscillator 51A as a time reference source, and the oscillation signal is frequency-divided to a signal having a predetermined period by the frequency divider 52, having twelve stages of flip-flops, as shown in FIG. 17. The output Q12 of the twelfth stage of frequency divider 52 is output as an 8-Hz reference signal fs. Oscillator circuit 51, crystal oscillator 51A and frequency divider 52 form reference signal generator 56.

Rotation detector 53 includes a waveform shaper 61, which is connected to generator 20, and includes an amplifier, a comparator, a filter and the like (not shown). Waveform shaper 61 converts a sinusoidal wave signal into a rectangular wave signal, and then outputs rotation signal FG1 with noise filtered therefrom.

Rotation signal FG1 from rotation detector 53 and reference signal fs from reference signal generator 56 are respectively input to an up count input and a down count input of an up/down counter 54 via a synchronizing circuit 70. Synchronizing circuit 70 includes four flip-flops 71 and an AND gate 72, and synchronizes rotation signal FG1 with reference signal fs (8 Hz) using output Q5 (1024 Hz) from the fifth stage of frequency divider 52 and output Q6 (512 Hz) from the sixth stage of frequency divider 52 and adjusts the pulses of these signals so that they are not concurrently output.

Up/down counter 54 is a 4-bit counter, which receives, at its up-count-input, a signal based on rotation signal FG1 from synchronizing circuit 70, and receives, at its down count input, a signal based on reference signal fs from synchronizing circuit 70. With this arrangement, up/down counter 54 effectively concurrently counts reference signal fs, rotation signal FG1 and determines the difference between the two counts.

Up/down counter 54 is provided with four input terminals (preset terminals) A through D. Terminals A, B and D are pulled up to a high level, setting the initial value (preset value) of up/down counter 54 at "11". Connected to the load input of up/down counter 54 is an initializing circuit 91, which is connected to power supply 22 and outputs a system reset signal SR depending on the voltage of power supply 22.

Up/down counter 54 does not accept the up and down inputs until system reset signal SR is transmitted, prior to which point up/down counter 54 is maintained at the count of "11". Up/down counter 54 transmits 4-bit outputs QA–QD, which are fed to a line decoder 100. Line decoder 100 provides outputs Y0–Y15, corresponding to counts "0"–"15" of up/down counter 54. Outputs Y0 and Y15 of line decoder 100 are input to respective NAND gates 102 to which the outputs of synchronizing circuit 70 are also applied. When the up-count signal is fed a plural number of times causing the count to rise to "15", a low-level signal is transmitted from output Y15. If, at that point, a further up count-input-signal is input to NAND gate 102, the input is canceled, and no further up-count signal is input to up/down counter 54. In this way, the count is prevented from shifting from "15" to "0", or shifting from "0" to "15".

A NAND gate 211 is connected to outputs Y12–Y15 of line decoder 100 and acts as a governing brake signal generator 210. When one of outputs Y12–Y15 is selected, namely, when the count is within a count range from "12" to "15" (the first set value), a high-level output is transmitted as a brake signal BKS2. When the count is "11" or lower (other than the first set value), a low-level signal is output.

Brake signal BKS2 is input to a NOR gate 201, and a brake signal BKS3 output by the NOR gate 201 is input to transistor 23A. When up/down counter 54 becomes the first set value ("12"–"15"), brake signal BKS2 is a high-level signal, brake signal BKS3 output by the NOR gate 201 is driven at a low-level, and transistor 23A is activated, thereby shorting generator 20 to apply a brake thereto.

The output Y0 of the line decoder 100 is coupled to the CK input of a flip-flop 222 via an inverter 221. Since the D input of flip-flop 222 is constantly supplied with a high-level signal, flip-flop 222 outputs a high-level signal at its Q output when up/down counter 54 outputs the count "0" giving a low-level signal at output Y0. Even when up/down counter 54 give a value other than "0" (for example, "1"), the Q output of flip-flop 222 remains at a high level until a signal enters the CLR input of flip-flop 222 for clearance.

The output FBS of flip-flop 222 is input to NOR gate 201. When up/down counter 54 provides count "0", output FBS of flip-flop 222 becomes a high-level signal, driving brake signal BKS3 to a low-level at NOR gate 201. Transistor 23A remains activated, shorting generator 20 for braking. Output FBS is kept high until flip-flop 222 is cleared with a signal input to the CLR input. In this way, generator 20 is continuously braked. Inverter 221 and flip-flop 222 form hand-stopping brake signal generator 220.

Brake releasor 230 is connected to the CLR input of flip-flop 222 and includes a low-speed rotation detector 231, which receives rotation signal FG1 and outputs a high-level signal when detecting a rotational speed of generator 20 below the set value, a normally-open switch 232 that outputs a high-level signal when closed by the operation of an external operational member such as a crown, and an OR gate 233 for receiving signals from low-speed rotation detector 231, switch 232 and system reset signal SR.

Figure 18:
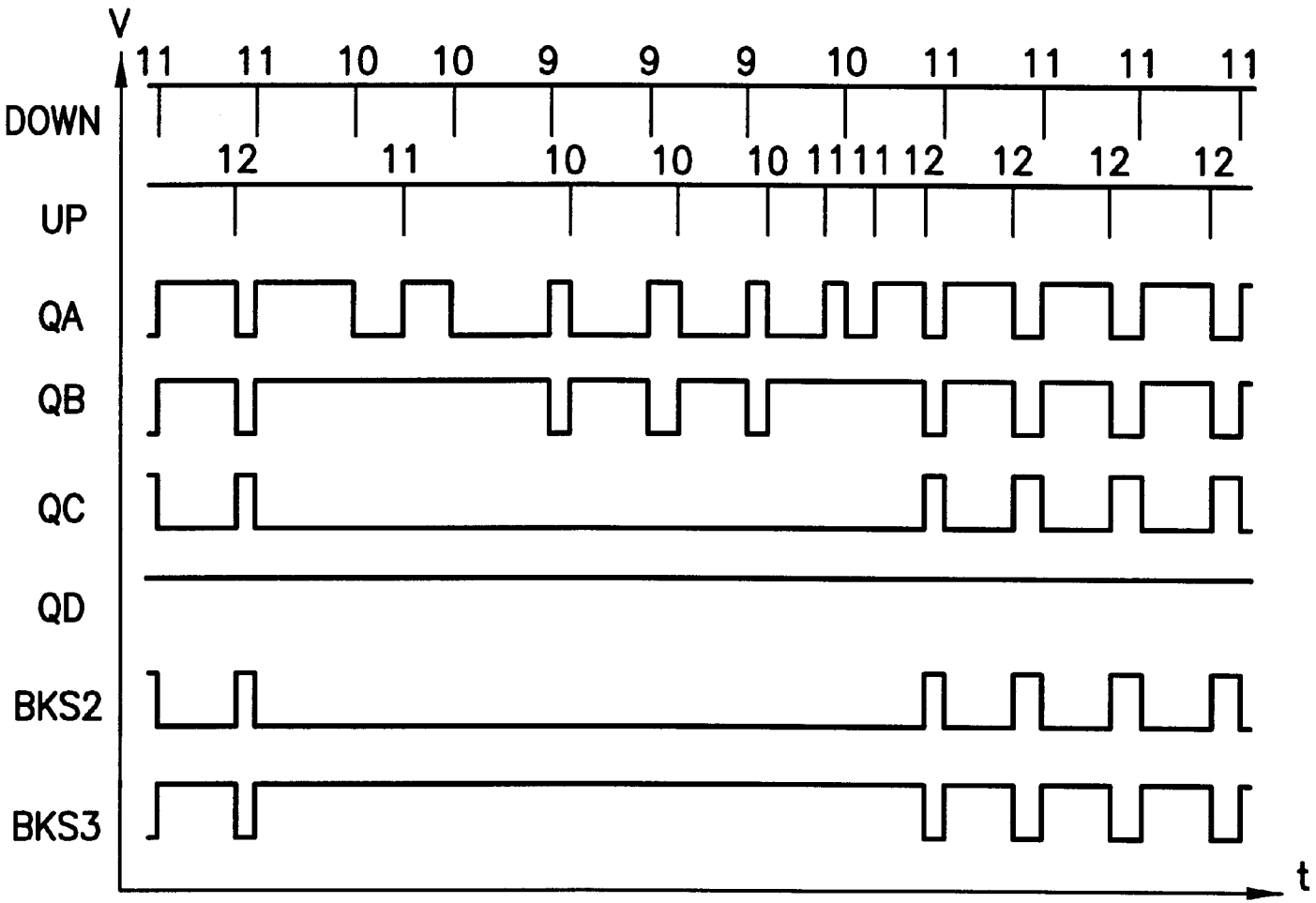
FIG. 18 is a timing diagram of the timepiece constructed in accordance with the fourth embodiment of the invention.
Figure 19:
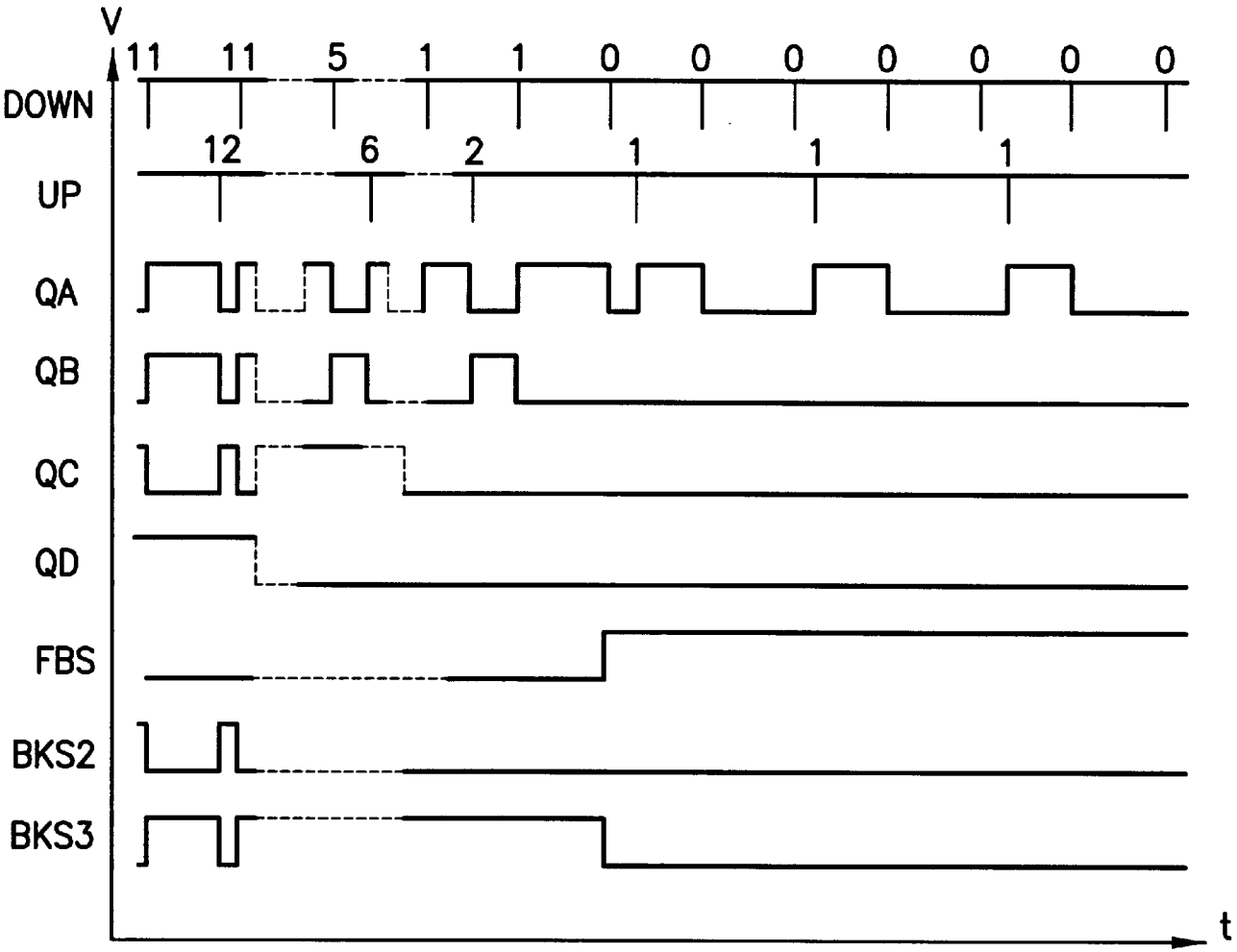
FIG. 19 is a timing diagram of the timepiece constructed in accordance with the fourth embodiment of the invention.
Figure 20:
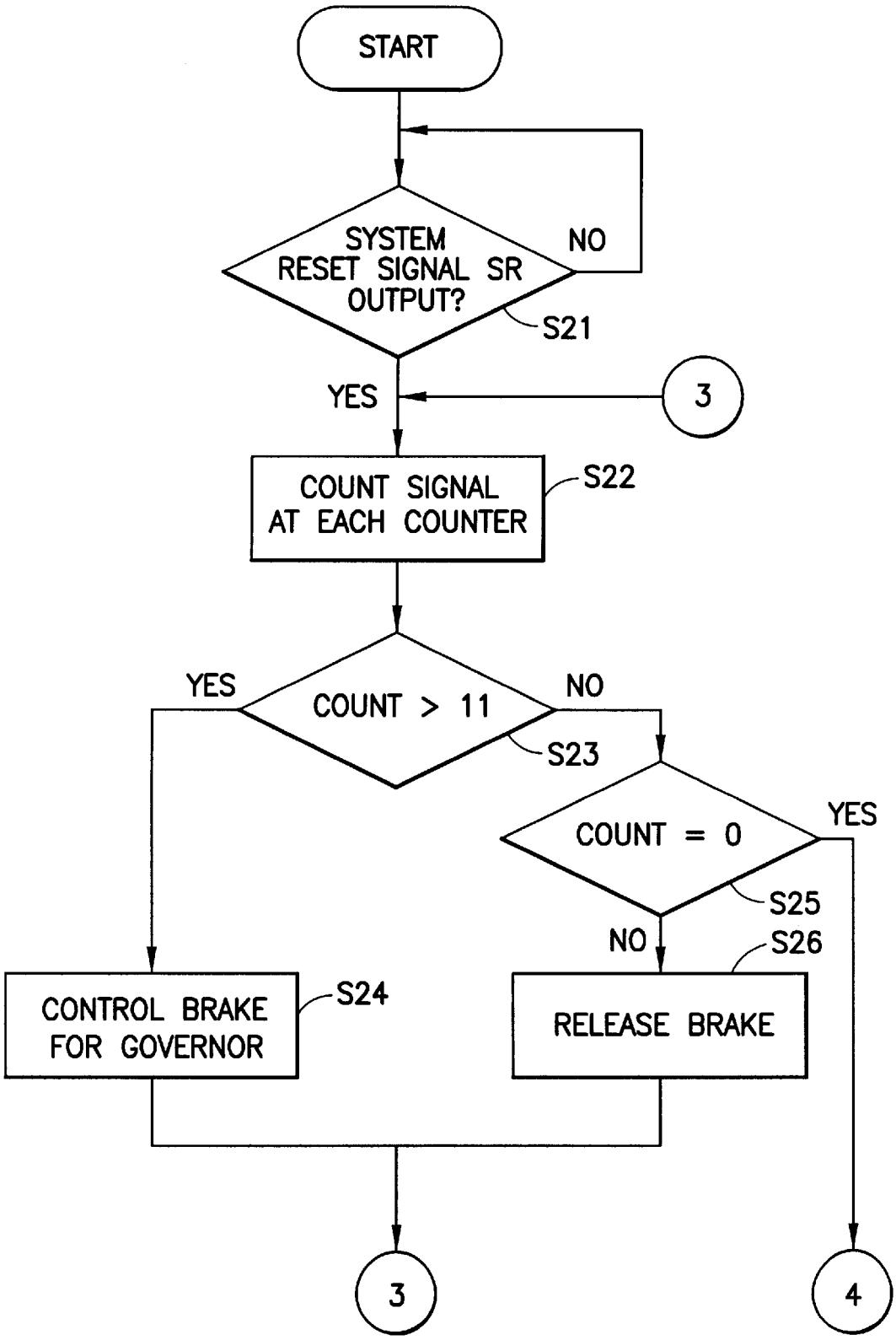
FIG. 20 is a flow diagram of the timepiece constructed in accordance with the fourth embodiment of the invention.
Figure 21:
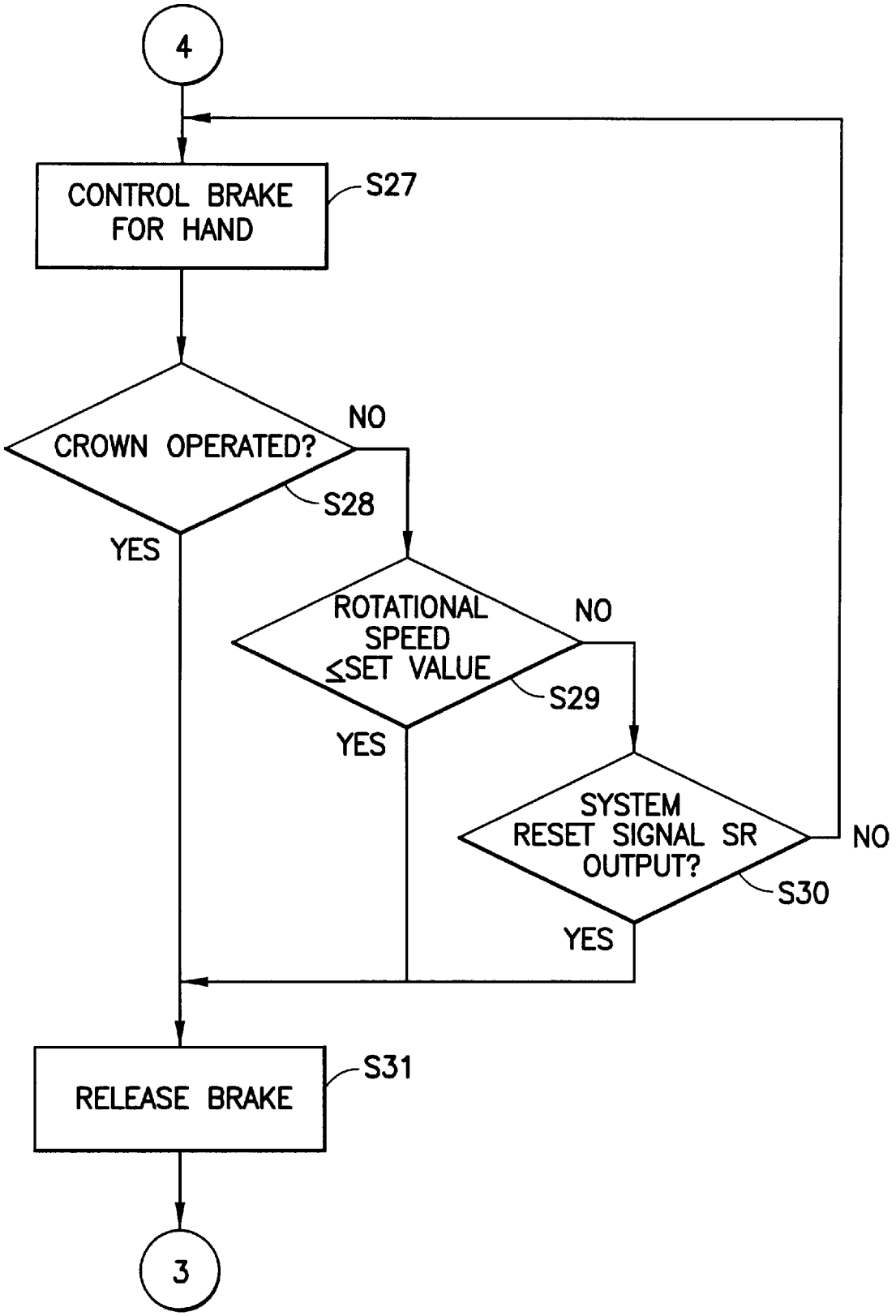
FIG. 21 is a flow diagram of the timepiece constructed in accordance with the fourth embodiment of the invention.

The operation of the fourth embodiment is now discussed referring to timing diagrams shown in FIGS. 18 and 19, and flow diagrams shown in FIGS. 20 and 21.

When generator 20 starts operating, causing initializing circuit 91 to output low-level system reset signal SR to the load input of up/down counter 54 (S21), the up-count signal based on rotation signal FG1 and the down-count signal based on reference signal fs are input to up/down counter 54 as shown in FIG. 18 (S22). These signals are adjusted through synchronizing circuit 70 so that they are not concurrently input to up/down counter 54.

When the up-count signal is input with the initial count of "11", the count is shifted to "12" and signal BKS2 from NAND gate 211 is driven to a high level. Since output FBS of flip-flop 222 in hand-stopping brake signal generator 220 remains low, NOR gate 201 inverts brake signal BKS2 as the brake signal BKS3 to be output, and brake circuit 23 applies a brake to generator 20 in the governing brake control (S23 and S24). When the count is "12" or higher (first set value), the brake is continuously applied.

When the down-count signal is input, causing the count to become "11" or lower (S23) but not "0" (a second set value) (S25), brake signal BKS2 of NAND gate 211 is driven to a low-level, releasing the braking of generator 20 (S26).

In such a brake control, generator 20 reaches a set rotational speed, and the up-count signal and the down-count signal are alternately input to up/down counter 54, causing the count to alternate between "12" and "11" in a locked state as shown in FIG. 18. In response to the count, the brake is alternately activated and deactivated.

In this manner, mainspring 1*a* is unwound, outputting a smaller torque, and the brake-activation time is gradually shortened. The rotational speed of generator 20 becomes close to the reference speed even when no brake is applied.

With no brake applied at all, the down count input signal is more frequently input, and up/down counter 54 gradually drops. When the count becomes the second set value "0" (S25), output FBS of flip-flop 222 is driven to a high-level, activating the hand-stopping brake control (FIG. 21) and thereby applying a brake on generator 20 (S27).

Once the hand-stopping brake control process begins, the brake is not released even if the up count input signal is input causing up/down counter 54 to be "1" or higher. Thus, generator 20 remains locked in a state of brake-activation. The hands of the watch thus become motionless or move at a very slow rate. When a user looks at the hand of the watch for the time, the user is alerted to the slow-turning or motionless hand. The user then operates an external operational member (not shown), such as the crown, to close switch 232 (S28); or low-speed rotation detector 231 determines that the rotational speed of generator 20 is lower than a predetermined set value (S29); or initializing circuit 91 transmits system reset signal SR (S30); and then a signal is input to the CLR input of flip-flop 222 for resetting, driving the output FBS low, and thereby releasing the brake on generator 20 (S31). The user may then tighten mainspring 1*a* and correct the watch time by hand-turning the watch.

The fourth embodiment of the present invention has the following advantages:

(12) Since rotation controller 50 includes hand-stopping brake signal generator 220 as well as governing brake signal generator 210 for performing the normal governing brake control, generator 20 is continuously braked when a drop in the torque of mainspring 1*a* lengthens the rotation period of generator 20 in excess of the reference period, slowing the turning of hand 13, and thereby leading to watch error. When the watch fails to turn the hands correctly, the hands can be made motionless or made to move at a slow speed. The user may be easily alerted to watch error by the hands when checking the time, and is thereby urged to correct the electronically-controlled, mechanical timepiece.

(13) Once generator 20 is braked by the hand-stopped brake signal generator 220, the braking is not released even when up/down counter 54 rises above the second set value ("0"). This arrangement helps the user recognize a stopped hand. The brake is only released using brake releasor 230. Before hand 13 is operated for time correction or mainspring 1*a* is tightened, the brake is released, and subsequent operations are smoothly performed.

(14) Switch 232 is provided as the brake releasor 230, which releases the hand-stopping brake control when the user operates the external operational member, such as the crown. The braking is thus released only when the user recognizes a slow-turning or motionless hand and operates the external operational member. In this way, the user is reliably alerted to the slow-turning or motionless hand.

(15) The crown permits an easier brake releasing operation than a separate dedicated button. Specifically, the user, alerted to the slow-turning hand, tightens mainspring 1*a* by winding the crown. The crown, if also designed to release the hand-stopping brake, eliminates the need for a separate dedicated button for releasing the braking, which assures the ease of operation of the watch.

Generator 20, coupled to hand 13, is continuously braked until the brake is released. After hand 13 is adjusted when the crown is pulled, the adjustment would be canceled when hand 13 is pushed back in, if the turning of hand 13 fails to restart the watch. The brake releasing is carried out at the moment the crown is pulled, and hand 13 is reliably set into motion when the crown is pushed in after the time adjustment. The time adjustment is thus efficiently performed, and the ease of operation of the watch is assured.

(16) Low-speed rotation detector 231 is further provided as brake releasor 230. The hand-stopping brake is automatically released without user intervention when generator 20 rotates at a rotation period longer than the predetermined set value or at a rotation period longer than the predetermined set value for a predetermined duration of time. The user, alerted to the slow-turning hand, adjusts hand 13 for the correct time, and the time adjustment is smoothly performed with the brake already released. The ease of operation of the watch is thus improved further.

(17) The system reset signal SR from initializing circuit 91 can also perform brake releasing as brake releasor 230. When the watch is left unused for a long period of time, power supply 22 stops feeding power to rotation controller 50, causing the rotation controller 50 to become inoperative. When mainspring 1*a* is then tightened again to restart the clock, generator 20 is reliably released from the brake. The initial clock operation is then smoothly performed.

(18) The up-count signal based on rotation signal FG1 and the down-count signal based on reference signal fs are input to up/down counter 54. When up/down counter 54 outputs the first set value ("12" or higher), generator 20 is continuously braked by brake circuit 23. When up/down counter 54 is lower than the first set value ("11" or lower), generator 20 is released from the brake. Generator 20 quickly approaches the reference speed even when the rotational speed of generator 20 deviates greatly from the reference speed at the startup, resulting in fast rotation control response.

(19) The governing brake control is set depending on whether the count is the first set value ("12" or higher) or not ("11" or lower). The hand-stopping brake control is set when the count becomes the second set value ("0"). This arrangement makes it unnecessary to set the brake timing separately. The simplified construction of rotation controller 50, reduces component cost and manufacturing cost, and thereby results in a low-cost electronically-controlled, mechanical timepiece.

(20) Since the timing of the input of the up-count signal varies depending on the rotational speed of generator 20, the duration of the first set value, namely, the brake application time is automatically adjusted. Fast and reliable response control is thus performed particularly in the locked state where the up-count signal and the down-count signal are alternately input.

Brake signal BKS3 for the governing is input at the time up-count signal FG2 is input to up/down counter 54. When the rotation period is quick or short, the brake application count per unit time is increased. When the rotation period is slow or long, the brake application count is decreased. This permits an appropriate brake control to be performed in accordance with the varying rotation period.

(21) The rotation controller 50 includes brake circuit 23, having transistor 23A, that shorts generator 20 for braking. Brake controller 200 feeds the brake signal of a rectangular pulse to transistor 23A to turn it on and off, thereby controlling generator 20 by braking. Brake circuit 23 has thus a simple construction, serving cost reduction purposes.

(22) The four-bit up/down counter 54 counts up to sixteen. When the up-count signal is repeatedly input, the inputs are cumulatively counted. Within a set range, namely, a range over which the count rises up to "15" or falls down to "0", when an up-count signal or a down-count signal is successively input, a cumulative error is corrected. Even if the rotational speed of generator 20 substantially deviates from the reference speed, generator 20 reverts back to the reference speed with the cumulative error reliably corrected, though it takes time for up/down counter 54 to reach the locked state. This control proves effective in maintaining an accurate hand turning.

(23) The use of up/down counter 54 permits the count, by which the hand-stopping brake control is performed, to be set to a value ("0") greatly spaced apart from the count "11", which is near the reference period. For this reason, even if the count drops due to a transient factor due to an impact exerted on the watch, the hand-stopping brake control is not commenced. The hand-stopping brake control is performed only when the rotation period of generator 20 becomes long compared with the reference period.

(24) When up/down counter 54 outputs the count of "12" or higher (first set value), namely, within a range of four counts from "12" to "15", the brake is applied. When up/down counter 54 outputs the count of "11" or lower, namely, within a range of eleven counts from "1" to "11", no brake is applied. In other words, the range of brake application is set to be narrower than the range of brake release in the count range of up/down counter 54. The cumulative correction range, where the rotor rotation period is longer than the reference period, is thus widened, permitting the reliable correction of the cumulative error that is likely to take place with no brake applied. The rotational speed of generator 20 is thus allowed to revert back to the reference speed.

Specifically, when the count is "12" or higher, a large torque of mainspring 1*a* reduces the possibility that transient factors such as mechanical variations give rise to the input of an up-count signal. With the brake applied, it is unlikely that three or four pulses of the up-count signal are consecutively input. Generator 20 is thus reliably controlled even if the range of brake application is set to be as narrow as a four-count range. On the other hand, when no brake is applied, the torque of mainspring 1*a* is typically lowered. A transient factor, such as mechanical variations or an impact exerted on the watch, may cause the down-count signal to be input consecutively a plural number of times.

As a result, in the fourth embodiment, a twelve-count range is set for the range of brake release. Even when the down-count signal is input consecutively a plural number of times, the cumulative value is stored and used to correct reliably the cumulative error.

A timepiece constructed in accordance with a fifth embodiment of the present invention is now discussed referring to FIGS. 22–27. Components identical or equivalent to those described in connection with the first embodiment are designated with the same reference numerals.

Figure 22:
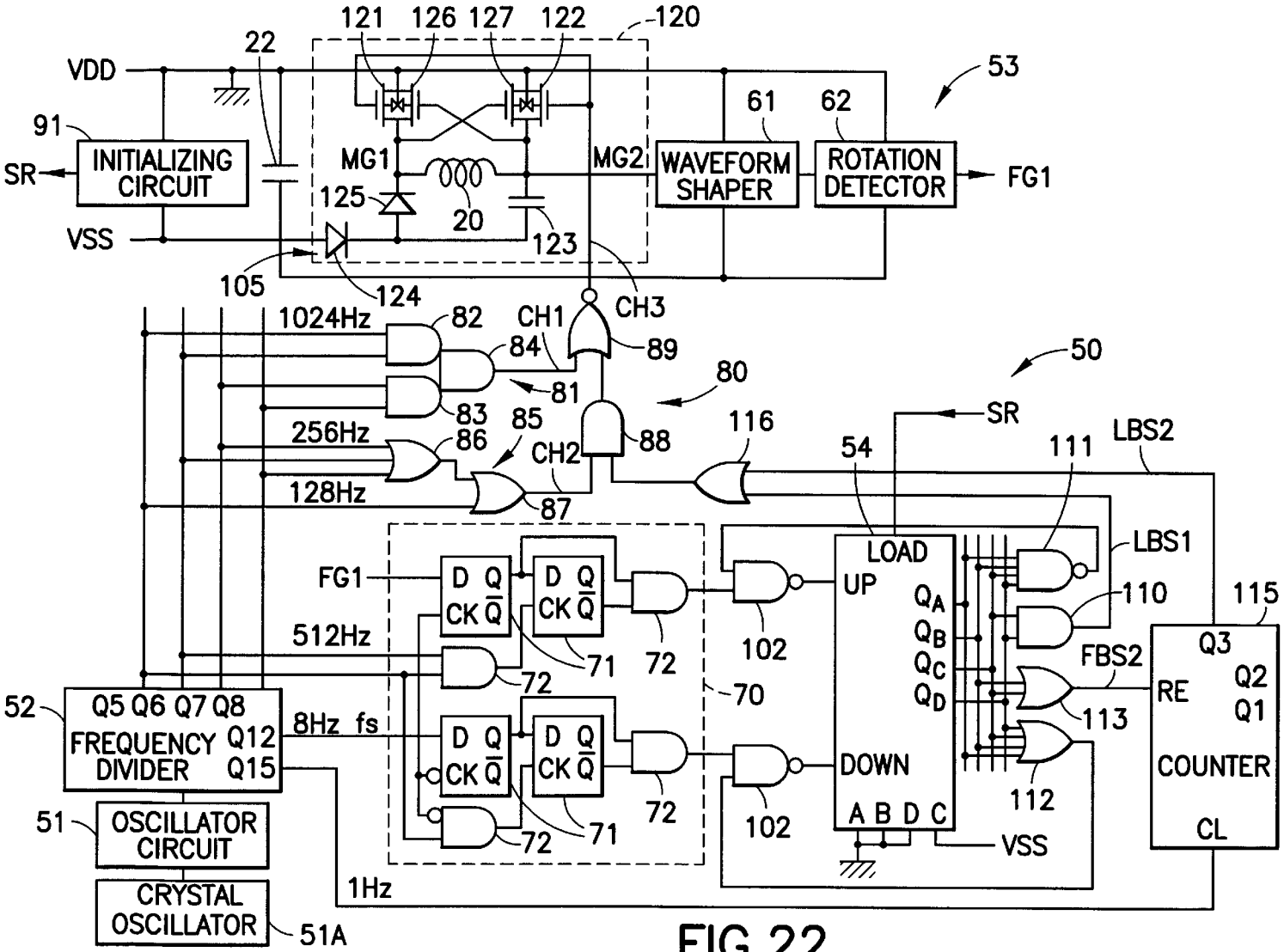
FIG. 22 is a schematic diagram of a timepiece constructed in accordance with a fifth embodiment of the invention.

Referring to FIG. 22, generator 20 is provided with a brake circuit 120 having a rectifier 105. Specifically, brake circuit 120 includes switches 121 and 122 attached at respective output terminals MG1, MG2 of generator 20 for shorting generator 20 for braking. In one embodiment, switches 121 and 122 are preferably P-channel transistors 126, 125. Voltage doubler rectifier 105 is constructed of a capacitor 123 connected to generator 20 connected in series with diode 125 and terminal MG1 and in series with diode 124 and transistors 126 and 127.

As in the preceding embodiments, brake circuit 120 is controlled by rotation controller 50, which is operated from power supplied by power supply (capacitor) 22 and includes a rotation detector 53, an up/down counter 54, a synchronizing circuit 70 and a chopper signal generator 80.

Rotation detector 53 includes a waveform shaper 61 connected to generator 20 through switches 121, 122 and a monostable multivibrator 62 in parallel with waveform shaper 61. Waveform shaper 61 includes an amplifier and a comparator (not shown), and converts a sinusoidal wave signal into a rectangular wave signal. Monostable multivibrator 62 works as a bandpass filter that passes pulses having a period longer than a certain value, and outputs a rotation signal FG1 with noise filtered therefrom.

Figure 23:
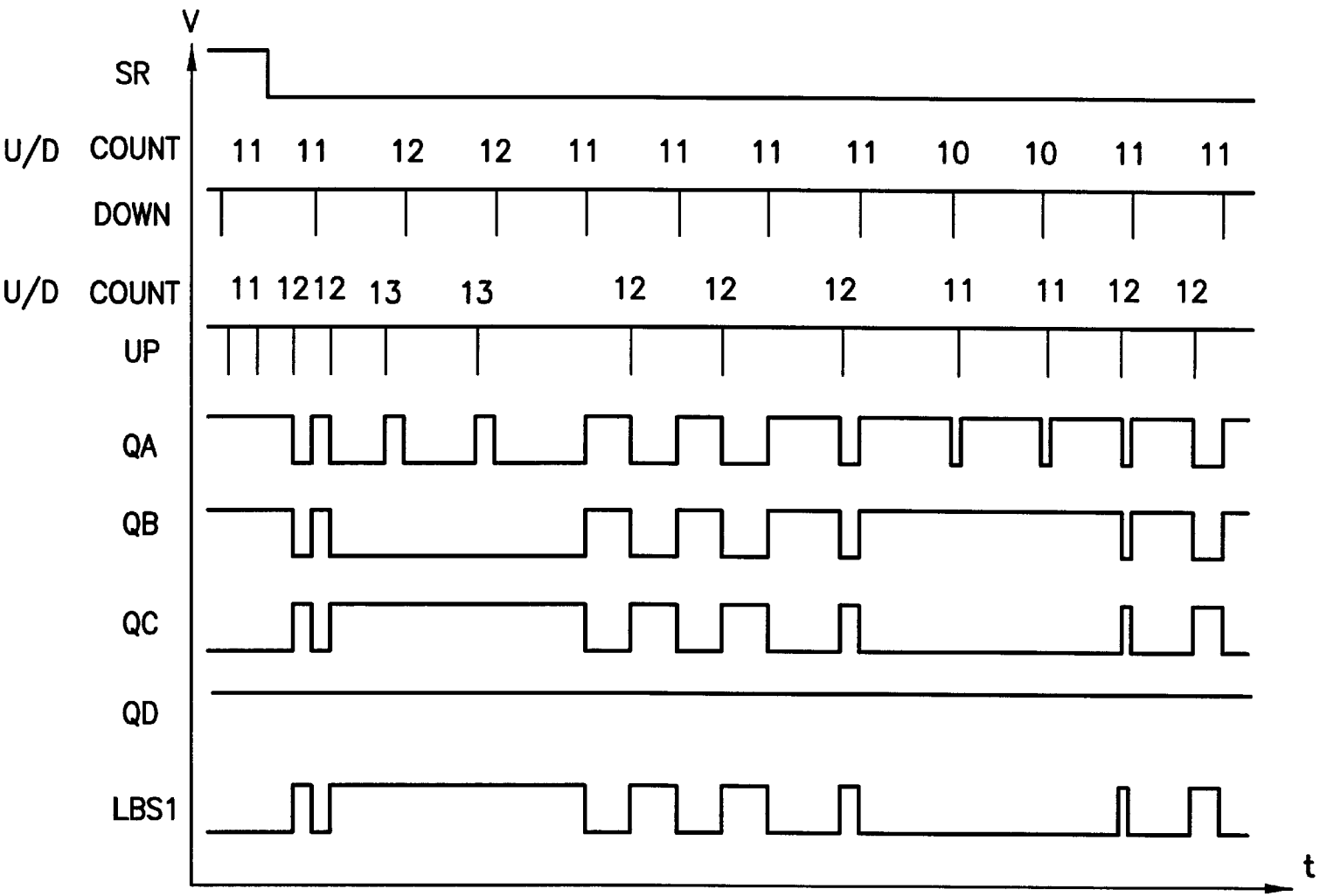
FIG. 23 is a timing diagram of a timepiece constructed in accordance with a fifth embodiment of the invention.

Rotation signal FG1 from rotation detector 53 and reference signal fs from frequency divider 52 are respectively input to an up count input and a down count input of up/down counter 54 via synchronizing circuit 70. Up/down counter 54 is like that used in the fourth embodiment; it is a four-bit counter with its initial count set to "11". Up/down counter 54 has four-bit outputs QA–QD. As shown in FIG. 23, when the count is a first set value ("12" or higher), both third and fourth bit outputs QC and QD transmit a high-level signal. When the count is "11" or lower, at least one of third and fourth bit outputs QC and QD transmits a low-level signal. The output LBS1 of an AND gate 110, to which outputs QC and QD are input, transmits a high-level signal when up/down counter 54 outputs the count of "12" or higher, and transmits a low-level signal when up/down counter 54 outputs the count of "11" or lower.

Outputs QA–QD are input to an NAND gate 111 and an OR gate 112. The outputs of NAND gate 111 and OR gate 112 are respectively fed to NAND gates 102, to which the outputs of synchronizing circuit 70 are respectively input. When the up-count signal is fed a plural number of times causing the count to rise to "15" and a low-level signal to be output from NAND gate 111, and a further up-count signal is input to NAND gate 102, the input is canceled, and no further up-count signal afterward is input to up/down counter 54. In the same manner as in the first embodiment, the count is thus prevented from shifting from "15" to "0", or shifting from "0" to "15".

Figure 25:
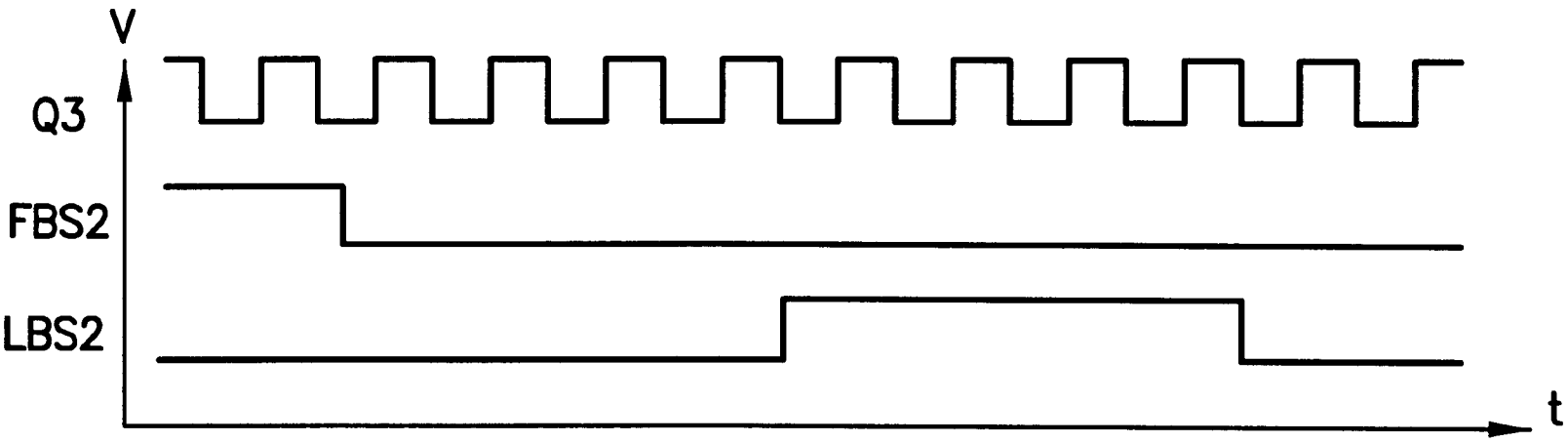
FIG. 25 is a timing diagram of the operation of a timepiece constructed in accordance with a fifth embodiment of the invention.

Outputs QB, QC and QD of up/down counter 54 are also input to OR gate 113, and the output FBS2 of OR gate 113 is input to a second counter 115. Referring to FIG. 25, second counter 115 is designed to start counting a 1-Hz clock from frequency divider 52 when up/down counter 54 gives the count of "0" or "1", driving output FBS2 to a low-level. Output LBS2 from a third bit output Q3 of second counter 115 alternates between a high-level signal and a low-level signal every four clocks, namely, every four seconds, of the 1-Hz clock.

Output LBS1 of AND gate 110 and output LBS2 of second counter 115 are input to an OR gate 116. The output of OR gate 116 is input to chopper signal generator 80. Since up/down counter 54 gives the count of "0" or "1", output LBS1 of AND gate 110 is a low-level signal, and output LBS2 is directly input to chopper signal generator 80.

When up/down counter 54 gives the count of "2" or higher, output FBS2 of OR gate 113 becomes a high-level signal, disabling second counter 115 and thereby causing LBS2 output to remain low, and output LBS1 of AND gate 110 is directly input to chopper signal generator 80.

Chopper signal generator 80 includes first chopper signal generator 81, constructed of three AND gates 82–84, for outputting a first chopper signal CH1 based on outputs Q5–Q8 of frequency divider 52, second chopper signal generator 85, constructed of two OR gates 86 and 87, for outputting a second chopper signal CH2 based on outputs Q5–Q8 of frequency divider 52, an AND gate 88 for receiving the output of OR gate 116 and output CH2 of second chopper signal generator 85, and a NOR gate 89 for receiving the output of AND gate 88 and output CH1 of first chopper signal generator 81.

Output CH3 of NOR gate 89 in chopper signal generator 80 is input to the gates of switches 121 and 122, constructed of P-channel transistors. When output CH3 is a low-level signal, switches 121 and 122 are activated, shorting generator 20 for braking. When CH3 is a high-level signal, switches 121 and 122 are deactivated, applying no brake on generator 20. The chopper signal from output CH3 thus controls generator 20 in chopping control.

Figure 24:
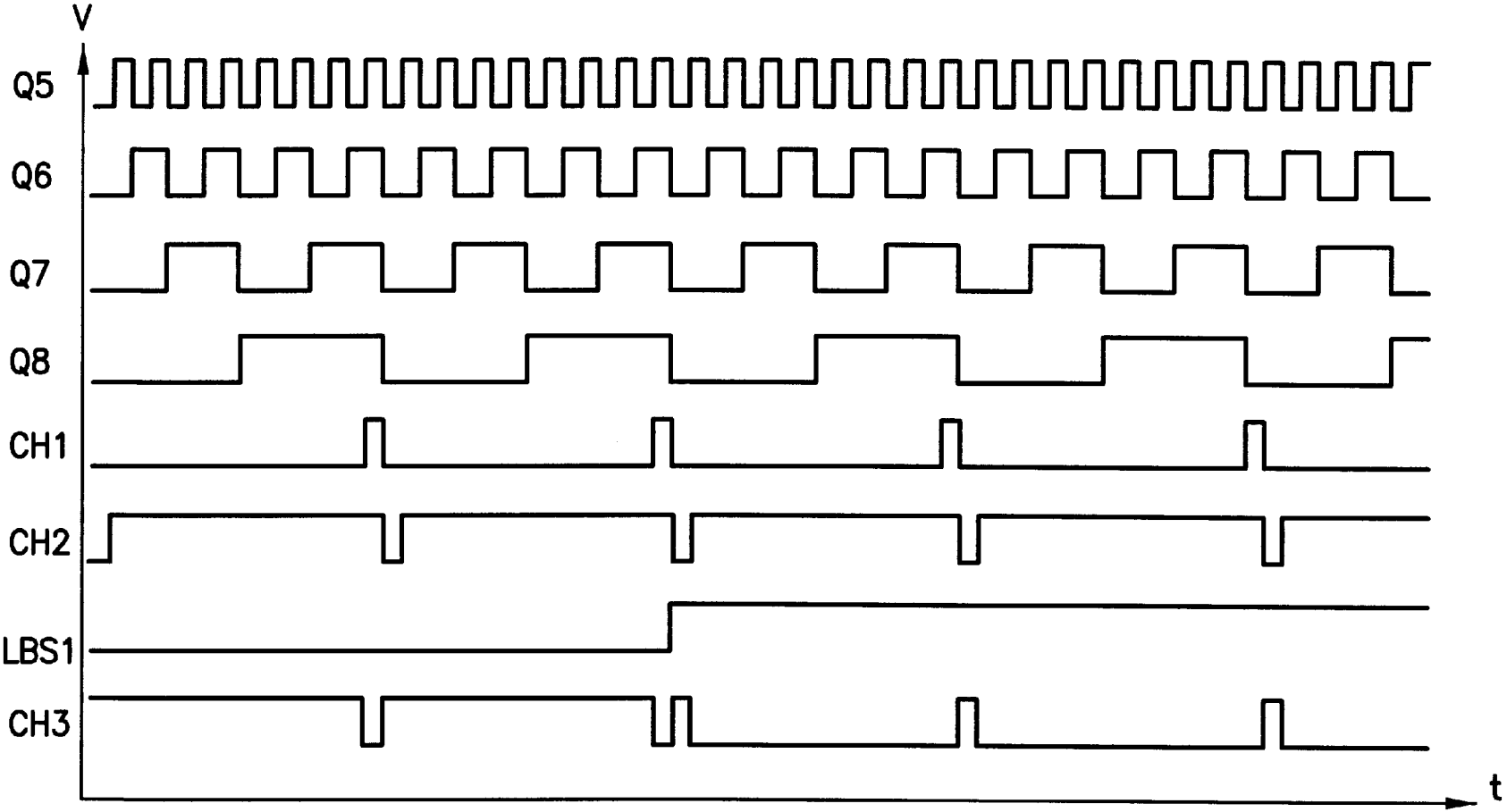
FIG. 24 is a timing diagram of the operation of the fifth embodiment of the timepiece of the invention.
Figure 26:
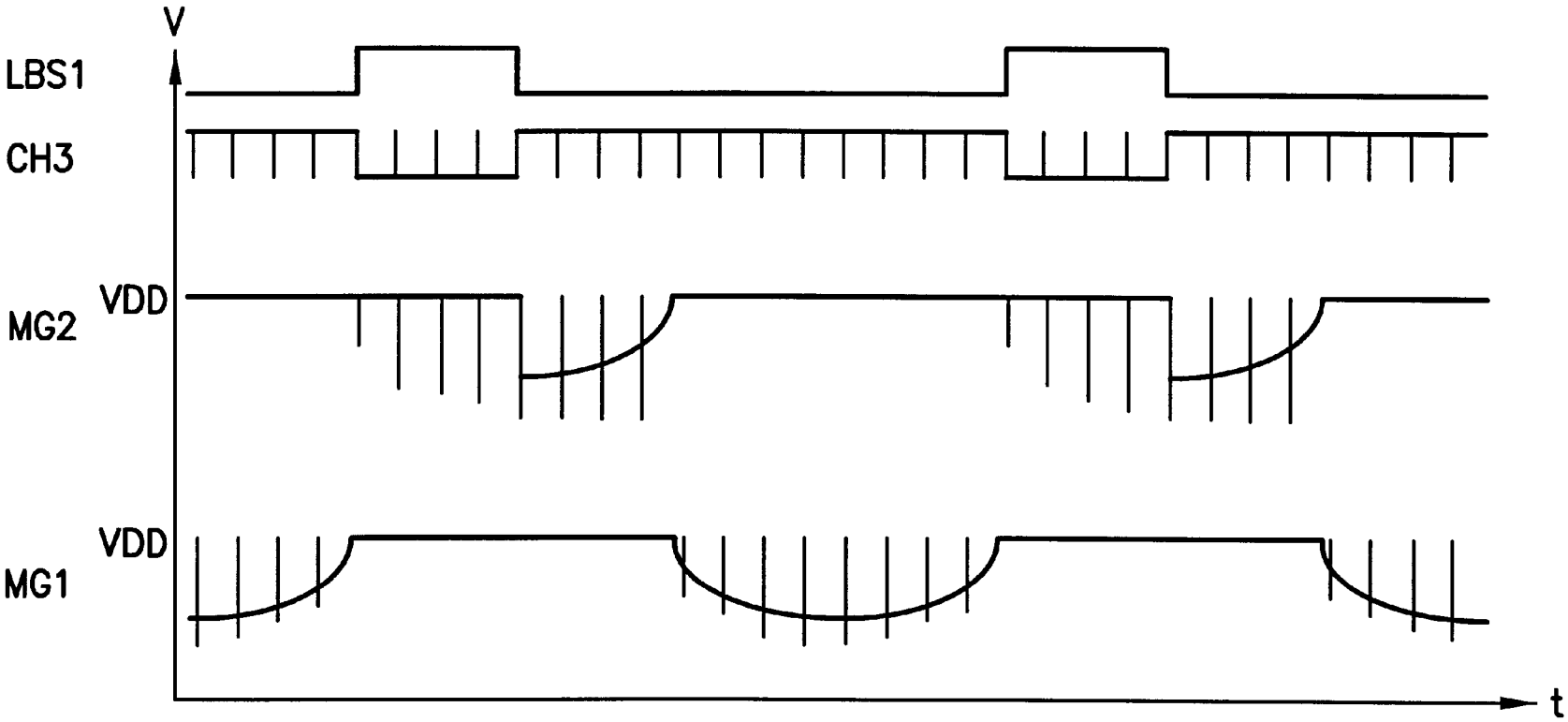
FIG. 26 is a waveform diagram of a timepiece constructed in accordance with a fifth embodiment of the invention.
Figure 27:
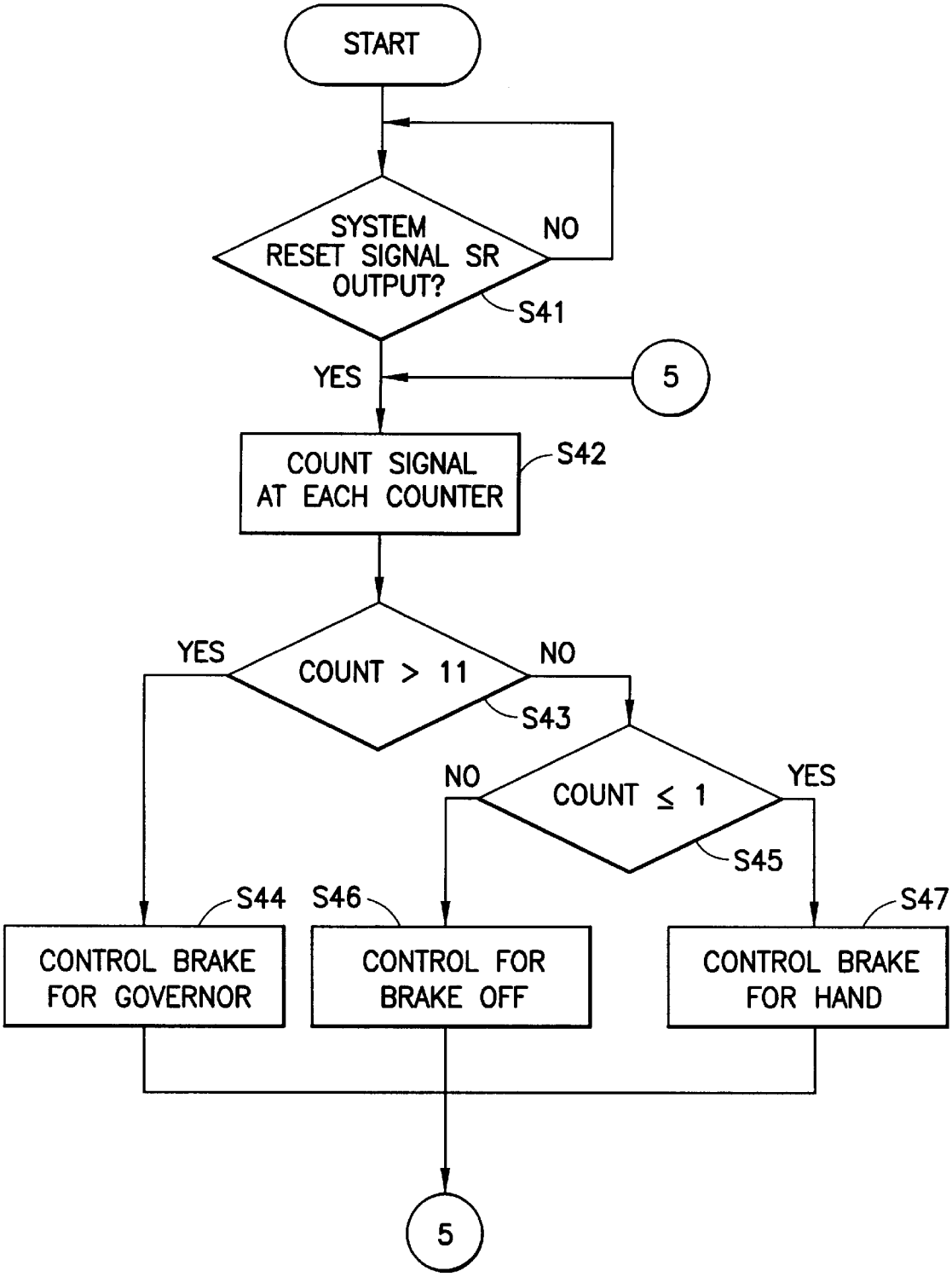
FIG. 27 is a flow diagram of control method of a timepiece constructed in accordance with the fifth embodiment of the invention.

The operation of the fifth embodiment is discussed referring to timing diagrams shown in FIGS. 23–25, an output waveform diagram shown in FIG. 26, and a flow diagram shown in FIG. 27, which depicts steps (S41) through (S47).

When generator 20 starts operating, causing initializing circuit 91 to output a low-level system reset signal SR to the load input of up/down counter 54 (S41), the up count input signal based on rotation signal FG1 and the down count input signal based on reference signal fs are input to up/down counter 54 as shown in FIG. 23. These signals are adjusted through synchronizing circuit 70 so that they are not simultaneously input to up/down counter 54.

When the up count input signal is input to up/down counter 54 with the initial count of "11", the count is shifted to "12", output LBS1 is driven to a high-level, and is directly input to AND gate 88 in chopper signal generator 80. When the down count input signal is input, causing the count to decrease to "11", output LBS1 is driven to a low-level and is directly input to AND gate 88 in chopper signal generator 80.

Referring to FIG. 24, in chopper signal generator 80, first chopper signal generator 81 produces output CH1 and second chopper signal generator 85 produces output CH2, based on outputs Q5–Q8 of frequency divider 52.

When the count becomes the first set value ("12"–"15") (S43), the output of AND gate 88 is driven to a high-level. Output CH3 of NOR gate 89 is a chopper signal, which is an inversion of output CH2, having a duty factor of a long low-level duration (brake-activation time) and a short high-level duration (brake-deactivation time). The brake-activation time of the reference period becomes long, and the governing brake control (brake-activation control) is provided to generator 20. The brake is turned off at regular intervals in chopper control, thereby controlling drop in generated power, while increasing braking torque (S44).

When the count is "11" or lower (S43) but the count is "2" or higher (S45), the output of AND gate 88 is a low-level signal. Output CH3 of NOR gate 89 is a chopper signal, which is an inversion of output CH1, having a duty factor (the ratio of turn on of the switch 121 to that of the switch 122) of a long high-level signal (brake-activation time) and a short low-level signal (brake-deactivation time). The brake-activation time of the reference period becomes short, and, practically, no brake is applied to generator 20. Specifically, the brake-deactivation control with a priority placed on power generation is performed (S46).

In the fifth embodiment, during the low-level LBS signal, the duty factor of chopper signal CH3 (high-level duration:low-level duration) is 15:1, namely, $1/16=0.0625$. During the high-level LBS signal, the duty factor of chopper signal CH3 is 1:15 (high-level duration:low-level duration), namely, $15/16=0.9375$.

Referring to FIG. 26, generator 20 outputs, across MG1 and MG2, an alternating current in accordance with the change in magnetic flux. Depending on output LBS1 and LBS2 signals, the chopper signals CH3 are a constant frequency but different duty factors are appropriately fed to switches 121 and 122. When the high-level LBS1 and LBS2 signals are output, namely, during brake-activation control, the braking time in each chopper cycle is lengthened, and the amount of braking increases, thereby reducing the rotational speed of generator 20. As the brake is applied, generated power is reduced, accordingly. However, energy accumulated during the braking is output when the chopper signal turns off switches 121 and 122, and is used to step up the output voltage of generator 20. In this way, a reduction in generated power during the braking is compensated for. The braking torque is thus increased while the reduction in generated power is restricted.

When low-level LBS1 and LBS2 signals are output, namely, during the brake-deactivation control, the braking time in the chopper cycle is shortened, increasing the rotational speed of generator 20. In this case, also, the chopper signal turns switches 121 and 122 from on to off, chopper voltage stepup results. The generated power is large compared with the generated power under the control under which no brake is applied at all.

The alternating current output of generator 20 is stepped up and rectified through voltage doubler rectifier 105, and charges power supply (capacitor) 22, which in turn drives rotation controller 50.

In this way, mainspring 1*a* is unwound, outputting a smaller torque, and the brake-activation time is gradually shortened. The rotational speed of generator 20 becomes close to the reference speed even when no brake is applied.

When the count drops down to the second set value ("1" or "0") (S45), hand-stopping brake control is performed (S47). During hand-stopping brake control, second counter 115 provides output LBS2 that alternates between high level and low level every four seconds, and inputs it to AND gate 88 in chopper signal generator 80, and the brake-activation control and brake-deactivation control are alternately performed on generator 20. Since the brake-activation control of four seconds is long relative to the rotation period of generator 20, the resulting brake is sufficiently strong to generator 20 to cause hand 13 to stop. When the count is the second set value, mainspring 1*a* presents a small torque, and even if braking is released every four seconds, hand 13 is unlikely to move. Hand 13 remains motionless, at least, during the four-second period when the brake is activated, noticeably slowing down hand 13. In this way, the user is alerted to the slow-turning or motionless hand, and is urged to tighten mainspring 1*a*.

Upon noticing the slow-turning or motionless hand, the user tightens mainspring 1*a*, and mainspring 1*a* transmits torque to generator 20. When the brake is activated on generator 20, generator 20 does not turn even if torque is applied thereto. During the hand-stopping brake control of this embodiment, however, the brake is released every four seconds. During which time generator 20 may be driven. When the up-count signal is fed with generator 20 moving, up/down counter 54 shifts from the second set value (to "2" or higher), the hand-stopping brake control is released and the watch reverts back to its normal operating condition.

The fifth embodiment provides advantages (12) and (18)–(24), which are described in connection with the fourth embodiment, and provides the following additional advantages:

(25) When up/down counter 54 reaches the second set value ("0" or "1"), the brake is repeatedly activated and deactivated for predetermined periods based on output LBS2 of second counter 115, thus permitting the user to tighten mainspring 1*a* upon noticing the slow-turning hand to operate generator 20 during the brake release period. Up/down counter 54 then rises to "2" or higher, releasing the hand-stopping brake control and returning the watch to the normal operating condition. Thus, the timepiece of the fifth embodiment does not require brake releasor 230 of the fourth embodiment, thereby eliminating the need for the separate brake release operation. This arrangement not only assures the ease of operation, but also reduces the cost of the watch.

(26) Because two types of chopper signals CH3 having different duty factors are used to perform brake-activation control and brake-deactivation control, the magnitude of braking (braking torque) is increased without lowering the charging voltage (generated voltage). Since the chopper signal having a large duty factor is used for control purposes, particularly during the period when the brake is activated, braking torque is increased while minimizing the loss in charging voltage. In this way, the reliability of the watch is maintained while an efficient brake control is attained at the same time. Further, the life of the timepiece is prolonged.

(27) Because the chopper signal used for the chopper control during the brake-deactivation control period has a small duty factor, the charging voltage is increased during the period when the brake is deactivated.

(28) The change in the output level of output QD, namely, the switch timing between the brake-activation control and the brake-deactivation control, is synchronized with the transition of chopper signal CH3 from on to off. Impulses having a high voltage component are regularly output in synchronization with chopper signal CH3 of generator 20. This output may be used as a watch error measurement pulse.

Thus, when output LBS and chopper signal CH3 are not synchronized with each other, generator 20 generates high voltage component at the change in output LBS, independently from constant period chopper signal CH3. For this reason, the "impulses" in the waveform of the output voltage from generator 20 do not necessarily have a constant period, and are not appropriate for use as the watch error measurement pulse. However, if the synchronization is assured as in this embodiment, the impulses can serve as the watch error measurement pulse.

(29) The fifth embodiment makes use of the two types of control: the governing brake control and the hand-stopping brake control. These controls achieve different brake application times by using the outputs of up/down counter 54 and second counter 115, and each use the remaining components including synchronizing circuit 70, chopper signal generator 80, and brake circuit 120. The component count and the cost of the watch are thus reduced.

Figure 28:
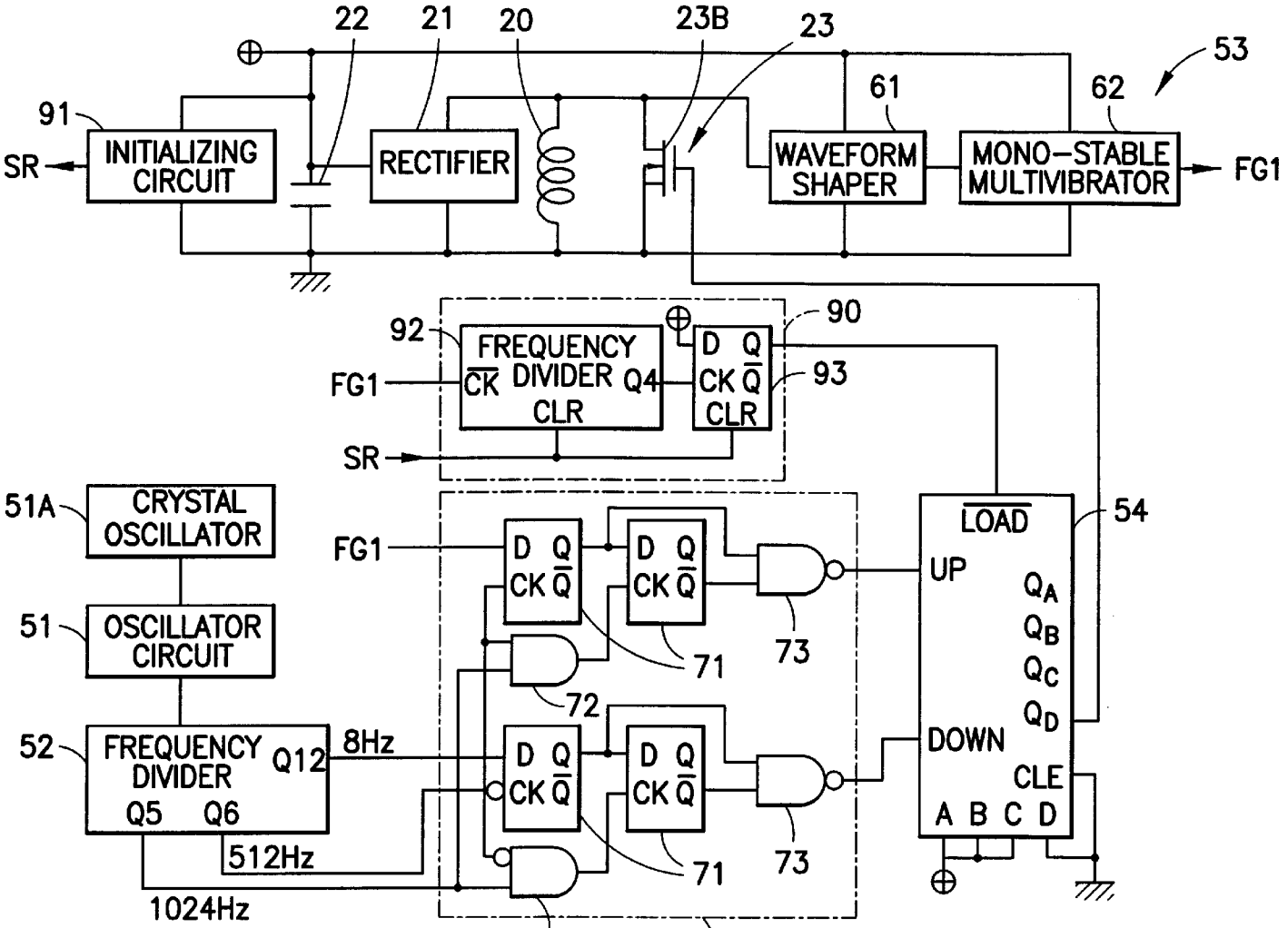
FIG. 28 is a schematic diagram of a timepiece constructed in accordance with a sixth embodiment of the invention.

A timepiece constructed in accordance with a sixth embodiment of the present invention is now discussed referring to FIG. 28. Like numerals are used to indicate like structures from previous embodiments. Rather than using the first and second set values in up/down counter 54, the sixth embodiment performs both the governing brake control and the hand-stopping brake control by using a single set value.

Specifically, in the sixth embodiment, as in the first and fourth embodiments, brake circuit 23 includes a transistor 23B as a switching element, and connects to generator 20, and the output QD of up/down counter 54 controls brake circuit 23 to govern generator 20.

Up/down counter 54 receives, at its up-count-input and down-count-input via synchronizing circuit 70, respectively, rotation signal FG1 of rotation detector 53, which is constructed of waveform shaper 61 and monostable multivibrator 62, and reference signal fs from frequency divider 52 which acts as the reference signal generator.

Up/down counter 54 is a four-bit counter, which is provided with four data input terminals (preset terminals) A through D. Terminals A through C are pulled up to a high level, setting the initial value (preset value) of up/down counter 54 at "7".

A startup and initializing circuit 90 is connected to the load input of up/down counter 54. Startup and initializing circuit 90 includes an initializing circuit 91, connected to capacitor 22, for outputting a system reset signal SR when power is initially fed to capacitor 22, a frequency divider 92, which may be reset by system reset signal RS, for counting the predetermined number of pulses of rotation signal FG1, and a flip-flop 93, which may be reset also by system reset signal SR, for receiving the clock signal from frequency divider 92.

Frequency divider 92 is formed of four stages of flip-flops, and transmits a high-level signal to the load input of up/down counter 54 when flip-flop 93 receives sixteen pulses of rotation signal FG1 from the input of system reset signal SR. Since up/down counter 54 does not accept the up and down inputs until the transition of the load input to a high level, up/down counter 54 is maintained at the count of "7".

Up/down counter 54 is provided with four-bit outputs QA–QD. The fourth bit output QD outputs a low-level signal when the count is "7" or lower, and outputs a high-level signal when the count is "8" or higher. Output QD is connected to the gate of N-channel transistor 23B in brake circuit 23 which is connected in parallel with generator 20. When the count falls within a range of "8"–"15", output QD transmits a high-level signal to the gate of transistor 23B, and transistor 23B is activated, thereby shorting generator 20 and applying a brake on generator 20.

When the count falls within a range of "0" to "7", output QD transmits a low-level signal, which lowers the gate voltage of transistor 23B. Transistor 23B is thereby deactivated, which prevents generator 20 from being braked. Since brake circuit 23 is controlled by output QD of up/down counter 54, up/down counter 54 also serves as brake controller 200. Of the counts output by up/down counter 54, counts "8" through "15", serve as the first and second set values.

Unlike the preceding embodiments, up/down counter 54 is not associated with a NAND gate that prevents the count from shifting from the minimum value "0" to the maximum "15", or from the maximum value "15" to the minimum value "0". For this reason, up/down counter 54 shifts to the maximum count "15" when a down-count signal is further applied to up/down counter 54 when up/down counter 54 registers the minimum count "0", and shifts to the minimum count "0" when an up-count signal is further applied to up/down counter 54 when up/down counter 54 registers the maximum count "15".

In the sixth embodiment, as in the first embodiment, the count goes to "8" in response to the up count input signal that is input with the count at "7", output QD becomes a high-level signal, and generator 20 is braked in the governing brake control. As long as the count comes to within a range of "8"–"15" (first set value), generator 20 is continuously braked. When the down count input signal is input causing the count to fall to "7" or lower (first set value), output QD becomes a low-level signal, and generator 20 is released from braking.

In this way, mainspring 1*a* is unwound, outputting a smaller torque, and the time period in which the brake is activated is gradually shortened as shown in FIG. 8. The rotational speed of generator 20 becomes close to the reference speed even when no brake is applied.

Even with no brake applied at all, the down count input signal is more frequently input and the count gradually drops. When the count drops to "0", and then shifts to "15", output QD becomes a high-level signal, putting generator 20 in a brake control state. The brake is continuously applied as long as the count falls within a range of "8" through "15". Thus, when mainspring 1*a* outputs a small torque, the hand remains motionless. The count within a range of "8" through "15" serves as the first set value for the governing brake control and the second set value for the hand-stopping brake control, and the two controls are performed within the same count range. Whether the governing brake control or the hand-stopping brake control is performed is automatically determined by the magnitude of the torque of mainspring 1*a*.

When the brake control is performed with a small torque by mainspring 1*a*, the hand is held motionless or is moved at a very slow speed. When the user looks at hand 13 to check the time, the user will easily notice the slow-turning or motionless hand. Upon noticing the slow-turning or motionless hand, the user can tighten mainspring 1*a*, which in turn transmits torque to generator 20. If generator 20 is continuously in the brake on control state, generator 20 remains unable to function even under torque. In the sixth embodiment, in the absence of input of the rotation signal FG1, the 8-Hz reference signal fs is only input. Thus, the count is gradually changed, and within about one second, the brake-deactivation state is reached (the count falls within a range of "7"–"0"). In the meantime, generator 20 is allowed to function. When generator 20 operates causing initializing circuit 91 to output system reset signal SR, the initial state is recovered. With the time adjustment performed, the normal clocking state resumes.

The sixth embodiment provides the advantages numbered (12) and (18)–(23) provided by the fourth embodiment, and provides the following additional advantages:

(30) Up/down counter 54 is capable of changing its count between "0" and "15". Thus, brake control is performed not only when an up-count signal is input to up/down counter 54 with its initial count set "7", causing thereafter the count to rise to the first set value (within a range of "8" through "15"), but also when a down-count signal is input to up/down counter 54 with its initial count set to "7", causing the count to drop to "0" and then shift to the second set value, namely, the first set value ("15"–"8"). Up/down counter 54 thus serves as both the governing brake signal generator 210 and the hand-stopping brake signal generator 220. The component count and the cost of the watch are thus reduced.

(31) When up/down counter 54 gives a count other than the first (or second) set value, the brake is automatically released. In the hand-stopping state, the brake release is repeated at regular intervals, and the brake releasor 230 used in the first embodiment is no longer needed. This arrangement eliminates the need for a separate brake release operation, and assures the ease of operation while reducing the cost of the watch.

The present invention is not limited to the above embodiments, and is intended to cover various modifications and equivalent arrangements included within the spirit and scope of the appended claims.

For example, up/down counter 54 employs a 4-bit up/down counter, but a 3-bit or smaller up/down counter or a 5-bit or larger up/down counter may be employed. A larger bit-number counter increases the range of the count, presenting an increased range for storing a cumulative error. This is particularly useful in the control in the unlocked state immediately subsequent to the startup of generator 20. With a smaller bit-number counter, the range for storing the cumulative error is narrow, but since the count up and count down are repeated in the locked state, a 1-bit counter can work, contributing to the cost reduction of the watch.

The particular count "8" or "12" serves as a threshold. Alternatively, the brake may be applied anywhere within a range of "11" through "15". Preferably, the range of brake application is narrower than the range of brake release. However, depending on the setting on the watch, the range of brake application may be set to be equal to the range of brake release or the range of brake release may be set wider than the range of brake application.

The range of brake application preferably includes the maximum or minimum count (for example, "15" or "0"). With the maximum or minimum count included therein, the brake control signals may be easily formed using the outputs QA–QD of up/down counter 54. The construction of the brake controller is thus simplified.

The means of counting is not limited to the up/down counter. The first and second counter are separately arranged for the reference signal fs and the rotation signal FG1. In such a case, a comparator for comparing the counts from the counter needs to be separately arranged. The use of up/down counter 54 advantageously presents a simpler construction.

The use of startup and initializing circuit 90 is not a requirement, but is preferable in that a priority is placed on power generation at the startup of generator 20, permitting the rotation controller 50 to be fast driven. The construction of startup and initializing circuit 90 is not limited to that shown in connection with the preceding embodiments.

As in the third and fifth embodiments, the first, second, fourth and sixth embodiments may perform chopping control in which the chopper pulse is added to the brake signals applied to transistors 23A and 23B. The chopping control permits the increase in brake torque while keeping generated power above a constant level.

The construction of brake circuit 23, brake controller 200, synchronizing circuit 70 and the like are not limited to that described in connection with the preceding embodiments. Any appropriate construction known to those skilled in the art for these units may be employed.

The brake releasor is not limited to that described in the preceding embodiments. A brake-releasing button may be arranged as the external operational member. Pressing this button releases the brake.

In the fifth embodiment, the brake-activation and brake-deactivation are alternated every four seconds in the hand stopping brake control. The braking time for applying a brake, which is typically 2 to 6 seconds, may be determined considering the mechanical load of the watch and the torque of the mainspring.

In the fourth and fifth embodiments, the first set value is within the range of "12" through "15" in up/down counter 54. In the sixth embodiment, the first and second set values are within the range of "8" through "15". The first set value (including the case where the first set value is equal to the second set value) may be appropriately determined depending on the type of watch to be controlled and the number of bits of up/down counter 54. As in the preceding embodiments, if the range of brake application includes the maximum or minimum count (for example, "15" or "0"), the brake control signals may be easily formed using the outputs QA–QD of up/down counter 54. The construction of the brake control means is thus simplified.

In the fourth and fifth embodiments, the second set value, which are different from the first set value, is not limited to "0" and "1", but may be any range of values.

The construction of up/down counter 54 is not limited to the one already described. It is important that counter 54 count the up-count signal and down-count signal and determine the difference between both counts.

The first through third embodiments may include the governing brake signal generator 210, hand-stopping brake signal generator 220 and brake releasor 230, used in the fourth through sixth embodiments.

It is also to be understood that the following claims are intended to cover all of the generic and specific features of the invention herein described and all statements of the scope of the invention which, as a matter of language, might be said to fall therebetween.

What is claimed is:

1. A timepiece, comprising:

a mechanical energy source;

a generator;

a train wheel connecting said mechanical energy source and said generator, said mechanical energy source driving said train wheel to cause rotation of said generator, said generator converting rotation into electrical power;

a rotation controller coupled to said generator for controlling the rotation of the generator, said rotation controller including:

a rotation detector for detecting the rotation of said generator and generating a rotation signal corresponding to said rotation;

a reference signal generator for generating a reference signal based on a signal from a time reference source;

a brake controller for braking the rotation of said generator;

a first counter for counting a first count corresponding to said reference signal from said reference signal generator;

a second counter for counting a second count corresponding to said rotation signal from said rotation detector;

a comparator for comparing said first count and said second count;

said first counter, said second counter and said comparator forming an up/down counter which produces a third count in response to said first count and said second count;

said brake controller braking said generator when said third count of said up/down counter selectively falls within a first count range, said first count range extending over a first plurality of values; and said brake controller not braking said generator when said third count of said up/down counter selectively falls within a second count range, said second count range extending over a second plurality of values;

said first count range being distinct from said second count range.

2. The timepiece of claim 1, wherein said up/down counter counts and retains at least three values.

3. The timepiece of claim 1, wherein said rotation controller is inoperative when initially supplied with electrical power by said generator until the number of revolutions of said generator reaches a predetermined value.

4. The timepiece of claim 1, wherein a threshold is set in said up/down counter so that the braking of said generator is initiated when said third count of said up/down counter exceeds said threshold and braking is stopped when said third count falls below said threshold.

5. The timepiece of claim 1, wherein a threshold is set in said up/down counter so that the braking of said generator is initiated or released when said third count of said up/down counter crosses said threshold.

6. The timepiece of claim 4, wherein the count of said up/down counter is set within a range of ±1 of said threshold when said generator initially feeds electric power to said up/down counter.

7. The timepiece of claim 5, wherein the count of said up/down counter is set within a range of ±1 of said threshold when said generator initially feeds electric power to said up/down counter.

8. The timepiece of claim 1, wherein said first count range is narrower than said second count range.

9. A timepiece, comprising:

a mechanical energy source;

a generator;

a train wheel connecting said mechanical energy source and said generator, said mechanical energy source driving said train wheel to cause rotation of said generator, said generator converting rotation into electrical power;

a rotation controller coupled to said generator for controlling the rotation of the generator, said rotation controller including:

a rotation detector for detecting the rotation of said generator and for generating a rotation signal corresponding to said rotation;

a reference signal generator for generating a reference signal;

an up/down counter for receiving one of said rotation signal and said reference signal as an up-count signal and the other of said rotation signal and said reference signal as a down-count signal and producing a count; and a brake controller for controlling said generator by applying a governing brake on said generator when the rotation period of said generator decreases, causing said count of said up/down counter to reach a first predetermined value;

said brake controller braking said generator when said count of said up/down counter selectively falls within a first count range, said first count range extending over a first plurality of values; and said brake controller not braking said generator when said count of said up/down counter selectively falls within a second count range, said second count range extending over a second plurality of values;

said first count range being distinct from said second count range.

10. The timepiece of claim 9, wherein said brake controller applies a hand-stopping brake on said generator when the rotation period of said generator increases in the absence of the application of said governing brake, causing said count of said up/down counter to reach a second predetermined value.

11. The timepiece of claim 9, wherein said brake controller alternatively causes the application of said governing brake for a first predetermined period to said generator and the release of said governing brake for a second predetermined period when said counts equals said second predetermined value.

12. The timepiece of claim 11, wherein said second predetermined value is equal to said first predetermined value.

13. The timepiece of claim 12, wherein said up/down counter counts between a minimum count and a maximum count and shifts to the maximum count when a down-count signal is received by said up/down counter when said count is the minimum count, and shifts to the minimum count when an up-count signal is received by said count is the maximum count.

14. The timepiece of claim 9, wherein said brake controller comprises a chopper signal generator for transmitting a first chopper signal to said generator when said count is said first predetermined value.

15. The timepiece of claim 14, wherein said chopper signal generator transmits a second chopper signal to said generator when said count is not said first predetermined value.

16. A timepiece, comprising:

a mechanical energy source;

a generator:

a train wheel connecting said mechanical energy source and said generator, said mechanical energy source driving said train wheel to cause rotation of said generator, said generator converting rotation into electrical power;

a rotation controller coupled to said generator for controlling the rotation of the generator, said rotation controller including:

a rotation detector for detecting the rotation of said generator and for generating a rotation signal corresponding to said rotation;

a reference signal generator for generating a reference signal;

an up/down counter for receiving one of said rotation signal and said reference signal as an up-count signal and the other of said rotation signal and said reference signal as a down-count signal and producing a count; and a brake controller for controlling said generator by applying a governing brake on said generator when the rotation period of said generator decreases, causing said count of said up/down counter to reach a first predetermined value;

said brake controller applying a hand-stopping brake on said generator when the rotation period of said generator increases in the absence of the application of said governing brake, causing said count of said up/down counter to reach a second predetermined value;

said brake controller having a brake releasor for releasing said hand-stopping brake, and wherein said hand-stopping brake, once applied, is continuously applied until said hand-stopping brake is released by said brake releasor.

17. The timepiece of claim 16, wherein said brake releasor comprises a low-speed rotation detector for detecting the rotational speed of said generator, and wherein said brake releasor releases said hand-stopping brake when said low-speed rotation detector detects a rotational speed of said generator lower than a third predetermined value.

18. The timepiece of claim 16, wherein said brake releasor releases said hand-stopping brake when a predetermined duration of time elapses from the time said hand-stopping brake was applied.

19. A timepiece, comprising:

a mechanical energy source:

a generator;

a train wheel connecting said mechanical energy source and said generator, said mechanical energy source driving said train wheel to cause rotation of said generator, said generator converting rotation into electrical power;

a rotation controller coupled to said generator for controlling the rotation of the generator, said rotation controller including:

a rotation detector for detecting the rotation of said generator and for generating a rotation signal corresponding to said rotation;

a reference signal generator for generating a reference signal;

an up/down counter for receiving one of said rotation signal and said reference signal as an up-count signal and the other of said rotation signal and said reference signal as a down-count signal and producing a count;

a brake controller for controlling said generator by applying a governing brake on said generator when the rotation period of said generator decreases, causing said count of said up/down counter to reach a first predetermined value;

said brake controller applying a hand-stopping brake on said generator when the rotation period of said generator increases in the absence of the application of said governing brake, causing said count of said up/down counter to reach a second predetermined value; and said timepiece having an external member operatively coupled to a brake releasor such that said brake releasor releases said hand-stopping brake when said external member is operated.

20. The timepiece of claim 19, wherein said external member is a crown.

21. A method of controlling a timepiece generator, comprising the steps of:

counting a reference signal based on a signal from a time reference source to determine a first count, counting a rotation signal based on the rotation period of the generator to determine a second count, producing a third count in response to said first count and said second count; and controlling the generator by applying a brake on the generator when said third count falls within a first count range, said first count range extending over a first plurality of values, and by not applying a brake on the generator when said third count falls within a second count range, said second count range extending over a second plurality of values, said first count range being distinct from said second count range.

22. A method of controlling a timepiece generator, comprising the steps of:

inputting to an up/down counter a reference signal based on a signal from a time reference source and a rotation signal based on the rotation period of a generator, wherein one of said reference signal and said rotation signal is input as an up-count signal and the other of said reference signal and said rotation signal is input as a down-count signal; and applying a brake on the generator when said up/down counter falls within a first count range, said first count range extending over a first plurality of values, and not applying a brake on the generator when said up/down counter falls within a second count range, said second count range extending over a second plurality of values, said first count range being distinct from said second count range.

23. A method of controlling a timepiece generator, comprising the steps of: inputting to an up/down counter a reference signal based on a signal from a time reference source and a rotation signal based on the rotation period of a generator, wherein one of said reference signal and said rotation signal is input as an up-count signal and the other of said reference signal and said rotation signal is input as a down-count signal; and wherein, when said rotation period of the generator is less than said reference signal, causing the count of said up/down counter to fall within a first count range, said first count range starting at a first predetermined value and extending over a plurality of values, a governing brake is applied on the generator and, when the rotation period of the generator is greater than a reference period in the absence of the application of said governing brake on said generator, causing the count of said up/down counter to become a second predetermined value, a hand-stopping brake is applied on the generator.

* * * * *